US007101111B2

(12) United States Patent
Albritton

(10) Patent No.: US 7,101,111 B2
(45) Date of Patent: Sep. 5, 2006

(54) FLARED ENERGY ABSORBING SYSTEM AND METHOD

(75) Inventor: James R. Albritton, Fort Worth, TX (US)

(73) Assignee: Exodyne Technologies Inc., Fort Worth, TX (US)

( * ) Notice: Subject to any disclaimer, the term of this patent is extended or adjusted under 35 U.S.C. 154(b) by 0 days.

(21) Appl. No.: 10/379,748

(22) Filed: Mar. 5, 2003

(65) Prior Publication Data

US 2003/0175076 A1 Sep. 18, 2003

Related U.S. Application Data

(63) Continuation-in-part of application No. 09/832,162, filed on Apr. 9, 2001, now Pat. No. 6,536,985, and a division of application No. 09/832,162, which is a continuation-in-part of application No. 09/356,060, filed on Jul. 19, 1999, now Pat. No. 6,293,727.

(60) Provisional application No. 60/397,529, filed on Jul. 22, 2002.

(51) Int. Cl.
*E01F 15/00* (2006.01)

(52) U.S. Cl. ..... 404/6; 404/10

(58) Field of Classification Search ..... 404/6, 404/10; 256/13.1; 188/371, 377
See application file for complete search history.

(56) References Cited

U.S. PATENT DOCUMENTS

| | | | | |
|---|---|---|---|---|
| 2,837,176 | A | 6/1958 | Dropkin | 188/1 |
| 2,845,144 | A | 7/1958 | Bohn | 188/1 |
| 3,428,150 | A | 2/1969 | Muspratt | 188/1 |
| 3,779,591 | A | 12/1973 | Rands | 188/1 |
| 3,782,505 | A | 1/1974 | Armstrong | 188/1 |
| 3,944,187 | A | 3/1976 | Walker | 256/13.1 |
| 3,982,734 | A | 9/1976 | Walker | 256/13.1 |
| 4,008,915 | A | 2/1977 | Walker | 293/60 |
| 4,200,310 | A | 4/1980 | Carney, III | 280/784 |
| 4,321,989 | A | 3/1982 | Meinzer | 188/377 |

(Continued)

FOREIGN PATENT DOCUMENTS

| | | |
|---|---|---|
| EP | 0 042 645 A2 | 12/1981 |
| EP | 0149567 B1 | 3/1988 |
| EP | 0 286 782 A1 | 10/1988 |
| WO | WO 97/47495 | 12/1997 |
| WO | WO 00/68594 | 11/2000 |

OTHER PUBLICATIONS

Alpha 60 MD, "Think Fast!" brochure, by Energy Absorption Systems, Inc.
"Traiload Traffic Management Equipment" brochure, by Traiload Trailers Ltd., UK.

(Continued)

*Primary Examiner*—Gary S. Hartmann
(74) *Attorney, Agent, or Firm*—Baker Botts L.L.P.

(57) ABSTRACT

An energy absorbing system with one or more energy absorbing assemblies is provided to reduce or eliminate the severity of a collision between a moving motor vehicle and a roadside hazard. The energy absorbing system may be installed adjacent to a gore area and other relatively wide roadside hazards. One end of the system facing oncoming traffic is relatively narrow. The width at an opposite end of the system may be varied to accommodate relatively wide or large roadside hazards. A sled assembly may be provided with a cutter plate such that a collision by the motor vehicle with the sled assembly will result in the cutter plate tearing or ripping the energy absorbing element to dissipate energy from the motor vehicle collision.

12 Claims, 19 Drawing Sheets

U.S. PATENT DOCUMENTS

| | | | | | |
|---|---|---|---|---|---|
| 4,352,484 | A | | 10/1982 | Gertz et al. | 256/13.1 |
| 4,399,980 | A | | 8/1983 | van Schie | 256/13.1 |
| 4,407,484 | A | | 10/1983 | Meinzer | 104/256 |
| 4,452,431 | A | | 6/1984 | Stephens et al. | 256/13.1 |
| 4,635,981 | A | | 1/1987 | Friton | 293/1 |
| 4,645,375 | A | | 2/1987 | Carney, III | 404/6 |
| 4,655,434 | A | | 4/1987 | Bronstad | 256/13.1 |
| 4,674,911 | A | * | 6/1987 | Gertz | 404/6 |
| 4,678,166 | A | | 7/1987 | Bronstad et al. | 256/13.1 |
| 4,711,481 | A | | 12/1987 | Krage et al. | 293/133 |
| 4,815,565 | A | | 3/1989 | Sicking et al. | 188/32 |
| 4,822,208 | A | | 4/1989 | Ivey | 404/6 |
| 4,823,923 | A | | 4/1989 | Moyer | 188/376 |
| 4,909,661 | A | | 3/1990 | Ivey | 404/6 |
| 4,928,928 | A | | 5/1990 | Buth et al. | 256/13.1 |
| 5,011,326 | A | | 4/1991 | Carney, III | 404/6 |
| 5,022,782 | A | * | 6/1991 | Gertz et al. | 404/6 |
| 5,078,366 | A | | 1/1992 | Sicking et al. | 256/13.1 |
| 5,112,026 | A | | 5/1992 | Laturner | 256/13.1 |
| 5,199,755 | A | | 4/1993 | Gertz | 293/120 |
| 5,248,129 | A | | 9/1993 | Gertz | 256/13.1 |
| 5,295,757 | A | | 3/1994 | Ivey et al. | 404/6 |
| 5,387,049 | A | | 2/1995 | Duckett | 404/6 |
| 5,391,016 | A | | 2/1995 | Ivey et al. | 404/6 |
| 5,403,112 | A | | 4/1995 | Carney, III | 404/6 |
| 5,407,298 | A | | 4/1995 | Sicking et al. | 404/6 |
| 5,503,495 | A | | 4/1996 | Mak et al. | 404/6 |
| 5,547,309 | A | | 8/1996 | Mak et al. | 404/6 |
| 5,660,496 | A | * | 8/1997 | Muller et al. | 404/6 |
| 5,733,062 | A | | 3/1998 | Oberth et al. | 256/13.1 |
| 5,775,675 | A | | 7/1998 | Sicking et al. | 256/13.1 |
| 5,797,592 | A | | 8/1998 | Machado | 256/13.1 |
| 5,851,005 | A | | 12/1998 | Muller et al. | 256/13.1 |
| 5,868,521 | A | | 2/1999 | Oberth et al. | 404/6 |
| 5,868,527 | A | | 2/1999 | King et al. | 405/290 |
| 5,924,680 | A | | 7/1999 | Sicking et al. | 256/13.1 |
| 5,931,448 | A | | 8/1999 | Sicking et al. | 256/13.1 |
| 5,947,452 | A | | 9/1999 | Albritton | 256/13.1 |
| 5,957,435 | A | | 9/1999 | Bronstad | 256/13.1 |
| 5,988,598 | A | | 11/1999 | Sicking et al. | 256/13.1 |
| 6,022,003 | A | | 2/2000 | Sicking et al. | 256/13.1 |
| 6,109,597 | A | | 8/2000 | Sicking et al. | 256/13.1 |
| 6,129,342 | A | | 10/2000 | Bronstad | 256/13.1 |
| 6,244,571 | B1 | | 6/2001 | Reid et al. | 256/13.1 |
| 6,254,063 | B1 | | 7/2001 | Rohde et al. | 256/13.1 |
| 6,260,827 | B1 | | 7/2001 | Sicking et al. | 256/13.1 |
| 6,289,269 | B1 | | 9/2001 | Seiferling | 701/23 |
| 6,293,727 | B1 | | 9/2001 | Albritton | 404/6 |
| 6,308,809 | B1 | | 10/2001 | Reid et al. | 188/377 |
| 6,413,009 | B1 | | 7/2002 | Duckett | 404/6 |
| 6,416,041 | B1 | | 7/2002 | Sicking et al. | 256/13.1 |
| 6,428,237 | B1 | | 8/2002 | Duckett | 404/6 |
| 6,439,802 | B1 | | 8/2002 | Duckett | 404/6 |
| 6,485,224 | B1 | | 11/2002 | Dyke et al. | 404/6 |
| 6,536,985 | B1 | | 3/2003 | Albritton | 404/6 |
| 6,536,986 | B1 | | 3/2003 | Anghileri et al. | 404/6 |
| 6,632,044 | B1 | | 10/2003 | Duckett | 404/6 |
| 6,644,888 | B1 | | 11/2003 | Ochoa | 404/6 |
| 2001/0013596 | A1 | | 8/2001 | Sicking et al. | |
| 2002/0007994 | A1 | | 1/2002 | Reid et al. | |
| 2002/0127057 | A1 | | 9/2002 | Duckett | 404/6 |
| 2003/0057410 | A1 | | 3/2003 | Denman et al. | 256/13.1 |
| 2003/0210954 | A1 | | 11/2003 | Kang | 404/6 |

OTHER PUBLICATIONS

"When Lives Are at Stake in Highway Construction Zones . . . " by Syro, a Subsidiary of Trinity Industries.

"Renco Ren–Gard TMA (Truck Mounted Attenuator)," by Renco, Inc., Nov. 1992.

"Development of a Metal Cutting W–Beam Guardrail Terminal" (Interstate Steel has the "BEST") by Pfeifer, et al., Transp. Res. Report TRP–03–43–94, Sep. 1994.

Exodyne Technologies, Inc., *Low Cost Guardrail End–Treatment*, Final Report on Contract DTRS–57–92–C–00130, A Small Business Innovation Research Project, Oct. 30, 1995.

U.S. Department of Transportation Letter, Jun. 12, 1996.

U.S. Department of Transportation Letter, Oct. 30, 1996.

International Search Report for PCT/US97/09960, Sep. 3, 1997.

International Search Report for PCT/US99/18509, Jan. 12, 2000.

"Trinity Attenuating Crash Cushion (TRACC)—Installation and Repair Manual", an NCHRP Report 350 Crash Cushion. 21 Pages, Jan. 1, 2001.

U.S. Department of Transportation Letter addressed to J.M. Essex, P.E. with drawing of 2286–mn design and specification, and summary reports of tests conducted on Quad-Guard–Wide system. 14 Pages, Jul. 16, 1997.

U.S. Department of Transportation Letter addressed to Mr. Roger N. Egan 2 Pages, Jun. 21, 1996.

U.S. Department of Transportation Letter addressed to J.M. Essex, P.E. 2 Pages, Oct. 17, 1996.

International Search Report for PCT/US03/07583; 5 pages, Apr. 29, 2004.

Written Opinion for PCT/US03/07583; 6 pages, Sep. 3, 2004.

Communication from the European Patent Office transmitting a supplementary EP search report for EP03716502.4, 3 pages.

* cited by examiner

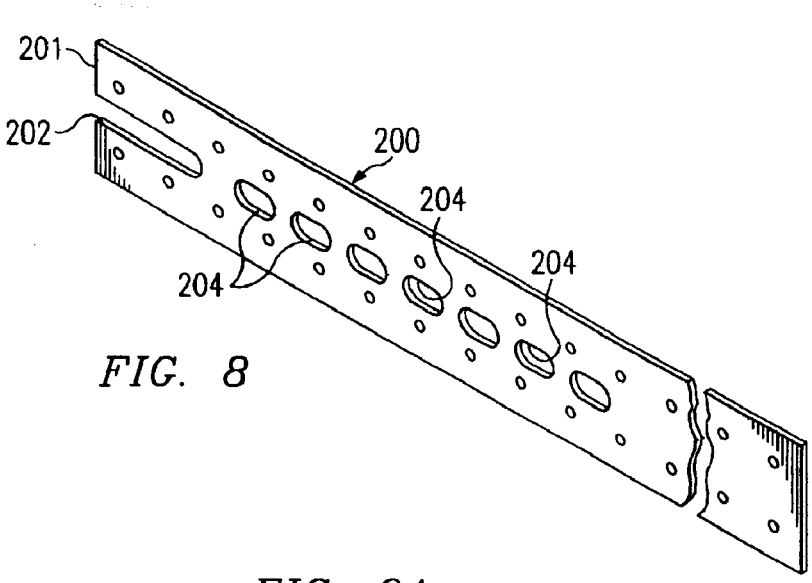
FIG. 8
FIG. 9A
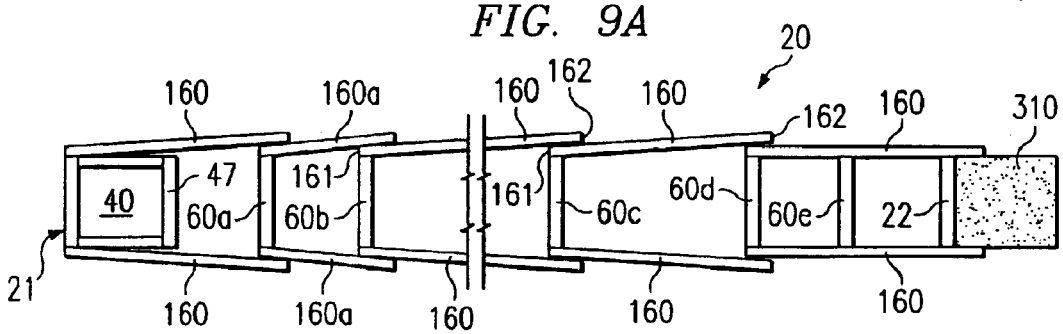
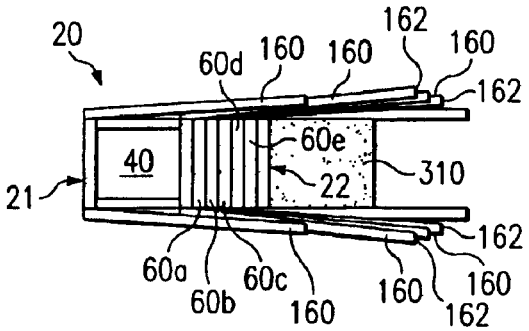
FIG. 9B
FIG. 9C
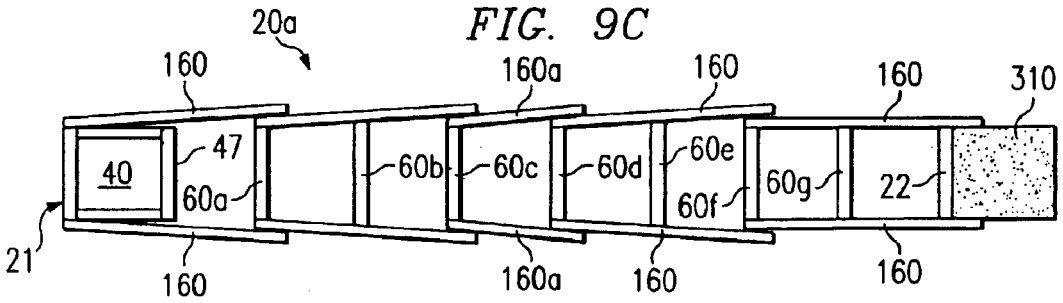

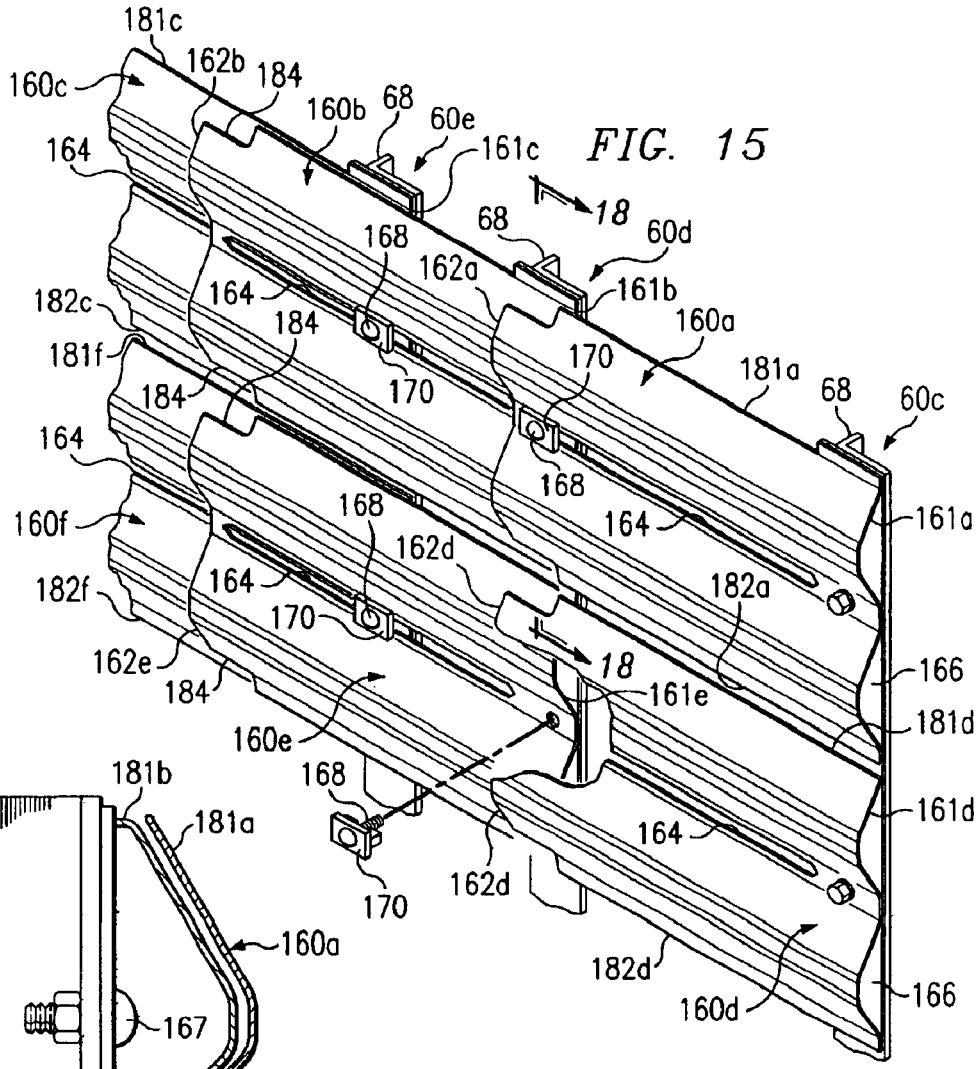
FIG. 15
FIG. 17B
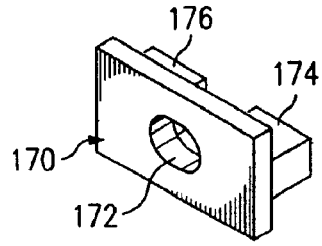

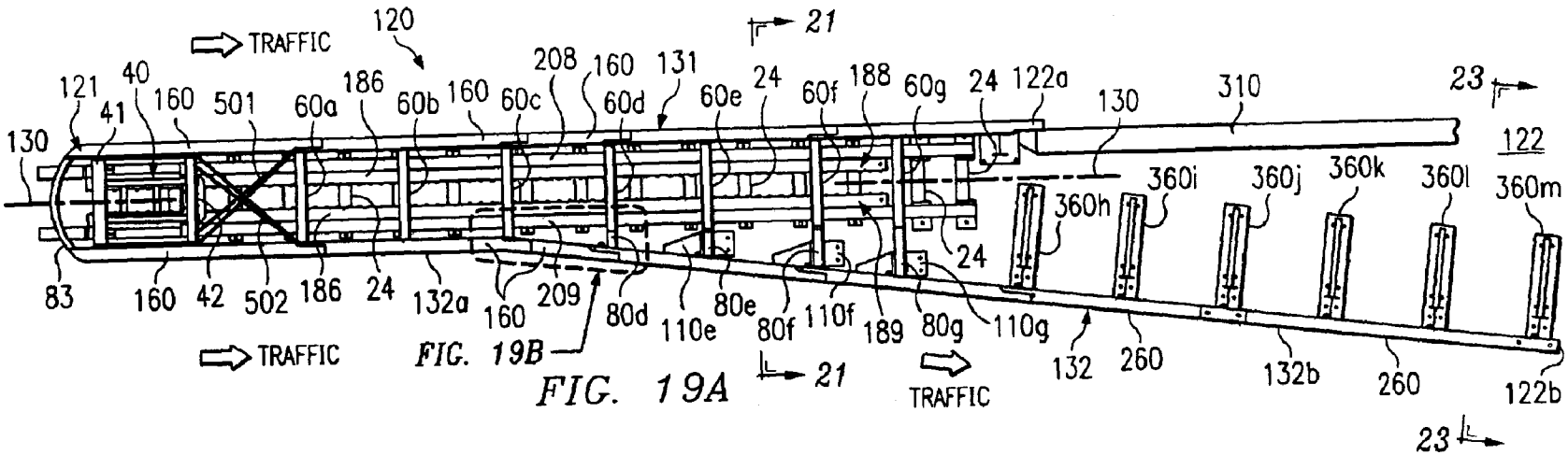
FIG. 19A
FIG. 19B
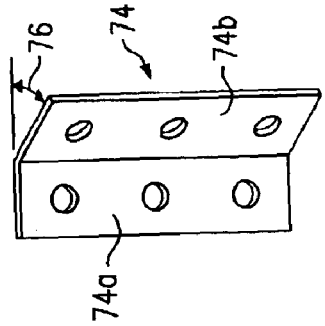
FIG. 19C
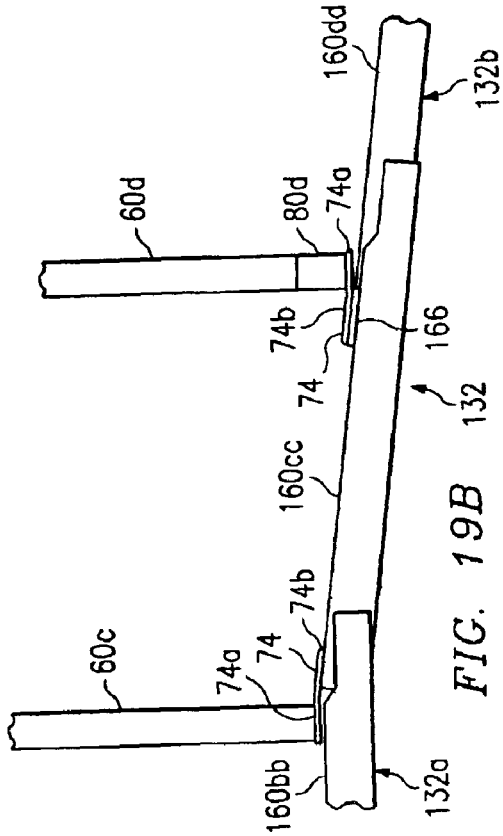
FIG. 19B

FLARED ENERGY ABSORBING SYSTEM AND METHOD

RELATED APPLICATIONS

This application claims the benefit, under 35 U.S.C. § 119(e), of previously filed provisional application Flared Energy Absorbing System and Method, Ser. No. 60/397,529, filed Jul. 22, 2002.

This application is a continuation-in-part of divisional application U.S. Ser. No. 09/832,162 filed Apr. 9, 2001 by James R. Albritton entitled Energy Absorbing System for Fixed Roadside Hazards, now U.S. Pat. No. 6,536,985.

Divisional application U.S. Ser. No. 09/832,162 filed Apr. 9, 2001, claims priority from continuation-in-part application U.S. Ser. No. 09/356,060 filed Jul. 19, 1999 by James R. Albritton entitled Energy Absorbing System for Fixed Roadside Hazards now U.S. Pat. No. 6,293,727.

TECHNICAL FIELD OF THE INVENTION

This invention relates in general to energy absorbing systems, and more particularly to an energy absorbing system used to reduce severity of a collision between a moving motor vehicle and a hazard located adjacent to a roadway.

BACKGROUND OF THE INVENTION

Various impact attenuation devices and energy absorbing systems have been used to prevent or reduce damage resulting from a collision between a moving motor vehicle and a fixed roadside hazard or obstacle. Examples of prior impact attenuation devices and energy absorbing systems include crash cushions or crash barriers with various structures and containers having crushable elements. Other crash barriers rely on inertia forces generated when material such as sand is accelerated during an impact to absorb energy.

Some of these devices and systems have been developed for use at narrow roadside hazards or obstacles such as at the end of a median barrier, end of a barrier extending along the edge of a roadway, large sign posts adjacent to a roadway, and bridge pillars or center piers. Such impact attenuation devices and energy absorbing systems are installed in an effort to minimize the extent of personal injury as well as damage to an impacting vehicle and any structure or equipment associated with the roadside hazard.

Examples of general purpose impact attenuation devices are shown in U.S. Pat. No. 5,011,326 entitled Narrow Stationary Impact Attenuation System; U.S. Pat. No. 4,352,484 entitled Shear Action and Compression Energy Absorber; U.S. Pat. No. 4,645,375 entitled Stationary Impact Attenuation System; and U.S. Pat. No. 3,944,187 entitled Roadway Impact Attenuator. Examples of specialized stationary energy absorbing systems are shown in U.S. Pat. No. 4,928,928 entitled Guardrail Extruder Terminal and U.S. Pat. No. 5,078,366 entitled Guardrail Extruder Terminal.

Examples of impact attenuation devices and energy absorbing systems appropriate for use on a slow moving or stopped highway service vehicle are shown in U.S. Pat. No. 5,248,129 entitled Energy Absorbing Roadside Crash Barrier; U.S. Pat. No. 5,199,755 entitled Vehicle Impact Attenuating Device; U.S. Pat. No. 4,711,481 entitled Vehicle Impact Attenuating Device; U.S. Pat. No. 4,008,915 entitled Impact Barrier for Vehicles.

Recommended procedures for evaluating performance of various types of highway safety devices including crash cushions is presented in *National Cooperative Highway Research Program* (*NCHRP*) *Report* 350. A crash cushion is generally defined as a device designed to safely stop an impacting vehicle within a relatively short distance. *NCHRP Report* 350 further classifies crash cushions as either "redirective" or "nonredirective". A redirective crash cushion is designed to contain and redirect a vehicle impacting downstream from a nose or end of the crash cushion facing oncoming traffic extending from a roadside hazard. Nonredirective crash cushions are designed to contain and capture a vehicle impacting downstream from the nose of the crash cushion. Redirective crash cushions are further classified as either "gating" or "nongating" devices. A gating crash cushion is one designed to allow controlled penetration of a vehicle during impact between the nose of the crash cushion and the beginning of length of need (LON) of the crash cushion. A nongating crash cushion is designed to have redirection capabilities along its entire length.

SUMMARY OF THE INVENTION

In accordance with teachings of the present invention, disadvantages and problems associated with previous energy absorbing systems and impact attenuation devices have been substantially reduced or eliminated. One aspect of the present invention includes an energy absorbing system which may be installed adjacent to relatively wide or large roadside hazards to protect occupants of a vehicle during collision with such roadside hazards. The system may include at least one energy absorbing assembly which dissipates energy from a vehicle impacting one end of the system opposite from a roadside hazard. The system may also include panels and associated panel support frames to redirect a vehicle impacting with either side of the system. At least a portion of the panel support frames and panels may be flared or diverge relative to each other to accommodate wide or large roadside hazards.

Another aspect of the present invention includes providing an energy absorbing system having a plurality of panel support frames and panels which may be installed between a roadside hazard and oncoming traffic. At least one set or group of the panel support frames and panels may be slidably disposed relative to each other. At least another set or group of the panel support frames and panels may be securely disposed relative to each other. When a vehicle collides with one end of the energy absorbing system facing oncoming traffic, the first group of panel support frames and panels may telescope or collapse relative to each other. The first group of panel support frames, associated panels and other components of the energy absorbing system cooperate with each other to absorb kinetic energy from the impacting vehicle and provide deceleration within acceptable limits to minimize injury to occupants within the vehicle. The panel support frames and panels also cooperate with each other and other components of the energy absorbing system to direct vehicles away from the roadside hazard and back onto the roadway following a side impact with the energy absorbing system.

Technical advantages of the present invention include providing a relatively compact energy absorbing system having a variable width to accommodate relatively large, wide roadside hazards and gore areas. Energy absorbing systems incorporating teachings of the present invention may be installed with either symmetric or asymmetric configurations. The energy absorbing system may be fabricated at relatively low cost using conventional materials and processes that are well known to the highway safety industry. The resulting system combines innovative structural and energy absorbing techniques that are highly predictable and reliable. Panel support frames and panels may be installed on location to accommodate the width of an associated roadside hazard or temporary work area.

In accordance with another aspect of the present invention, a crash cushion may be provided with multiple energy absorbing elements, a first set of panels and a second set of panels disposed adjacently to a roadside hazard facing oncoming traffic. The spacing or angle between the first set of panels and the second set of panels may be varied based on the width of an associated roadside hazard without reducing performance capabilities of the energy absorbing system. The energy absorbing elements cooperate with each other to allow varying the amount of deceleration applied to a vehicle impacting one end of the crash cushion opposite from the roadside hazard. For example, the crash cushion may include a first, relatively soft portion to absorb impact from small, lightweight vehicles, a middle portion with increased stiffness and a third or final portion with the greatest amount of stiffness to absorb impact from heavy, high speed vehicles.

Further technical advantages of the present invention may include providing relatively low cost crash cushions and safety systems which meet the criteria of NCHRP Report 350 including Test Level 3 Requirements and which may be installed adjacent to relatively wide roadside hazards such as five feet, eight feet or any other required width. A crash cushion having an energy absorbing assembly incorporating teachings of the present invention may be satisfactorily used during harsh weather conditions and is not sensitive to cold or moisture. The energy absorbing system may be easily installed, operated, inspected and maintained. The system may be installed on new or existing asphalt or concrete pads. Field assembly of impact attenuation devices and a basic energy absorbing system are not required. Easily replaceable parts allow quick, low cost repair after nuisance hits and side impacts. Elimination of easily crushed or easily bent materials further minimizes the effect of any damage from nuisance hits and/or side impacts with the crash cushion.

An energy absorbing system incorporating teachings of the present invention may be formed from at least one group of panel support frames and panels slidably disposed relative to each other and another group of panel support frames and panels which generally do not slide relative to each other. The panel support frames and panels may be used to satisfactorily absorb energy from a wide variety of vehicles colliding with an energy absorbing system at various angles including side impacts and "reverse" angle side impacts.

Technical benefits of the present invention include an energy absorbing system that may be used with permanent roadside hazards or may be easily moved from one temporary location (first work zone) to another temporary location (second work zone).

A further aspect of the present invention includes a crash cushion which may be used to minimize the results of a collision between a vehicle and a roadside hazard. The crash cushion may include an energy absorbing assembly extending in a first direction from a first end of the crash cushion. A plurality of panels may be located on a first side of the energy absorbing assembly extending generally in the first direction. The panels preferably resist impact from a vehicle with the first side. The panels may have a first section that may be generally disposed at a first orientation with respect to the first direction. The first section of panels may extend from the first end of the crash cushion to a location along the first side. The panels may have a second section extending from the location at a second orientation with respect to the first direction. The second section of panels preferably intersects the first section of panels at an angle.

For some applications a portion of the first section of panels may have a first divergence from the first direction and at least a portion of the second section of panels may have a second divergence from the first direction. The first divergence may be unequal to the second divergence. Also, the second section of panels may include a moveable subsection that moves generally in the first direction when the energy absorbing assembly moves in the first direction. The second section of panels may also include a fixed subsection with the moveable subsection disposed closer to the first end of the crash cushion than the fixed subsection. A plurality of panels may also be located on a second side of the energy absorbing assembly opposite from the first side extending generally in the first direction. The second side of panels may be disposed asymmetric with respect to the first side of panels.

Still another aspect of the present invention may include an energy absorbing system to limit or reduce the results of a collision between a vehicle and a roadside hazard. The system may include an energy absorbing assembly extending in a first direction from a first end of the system. The energy absorbing system may have a first side located on one side of the energy absorbing assembly and a second side located on another side of the energy absorbing assembly. The first side and the second side may each have respective panels which resist an impact by a vehicle to the first side or the second side. The first and second sides may move generally in the first direction when a vehicle impacts the first end of the system. At least a portion of the first side may be uncoupled from the second side so that the uncoupled portions of the first side may be oriented with respect to the first direction independently of the second side.

The energy absorbing system may include panel support frames coupled to the panels of the first side and the second side. At least one of the panel support frames may be coupled to a portion of the first side and separated from other panel support frames coupled to the second side. At least one of the panel support frames coupled to the portion of the first side may bear upon or rest upon a concrete pad, portions of an associated roadway or the ground adjacent to the energy absorbing system. The panel support frames that are coupled to the portion of the first side may be coupled to one or more outboard anchors to resist vehicle impacts to the first side.

Still another aspect of the present invention include a crash cushion operable to minimize the results of a collision between a vehicle and a roadside hazard. The crash cushion may have an energy absorbing assembly and panel support frames extending in a first direction from a first end of the crash cushion. The energy absorbing assembly may also be moveable in the first direction when a vehicle impacts the first end. The panel support frames may also be moveable in the first direction. Multiple panels may be attached to the panel support frames extending generally in the first direction. The panels may diverge from the first direction as the panels extend from the first end. Selected panels may have channels attached thereto. A cable may extend through at least one of the channels along the selected panels. The cable may be anchored at a location toward the first end of the crash cushion and also at a location away from the first end of the crash cushion. The cables may also be coupled to the panel support frames. The energy absorbing assembly may include a moveable sled disposed at the first end of the crash cushion. The cable anchored at a location toward the first end may be anchored to the sled.

Technical benefits of the present invention include a crash cushion operable to minimize the results of a collision between a vehicle and a roadside hazard. The crash cushion may include an energy absorbing assembly extending in a first direction from a first end of the crash cushion. The energy absorbing assembly may be moveable in the first direction when a vehicle impacts the first end. Multiple panel support frames may be moveable in the first direction. Multiple panels may be attached to the panel support frames. The panels may diverge from the first direction as the panels extend from the first end. The panel support frames may be slidably coupled to anchors so as to resist rotation when a vehicle impacts the panels. The panel support frames may be slidably coupled to anchors with at least one of the panel support frames bearing on the energy absorbing assembly and may be coupled to an outboard anchor. The panel support frames may be slidably coupled to anchors with at least one of the panel support frames bearing on the ground and may be coupled to an outboard anchor. The panel support frames may be slidably coupled to anchors with a hook located in a channel. The channel may be oriented in the first direction. The hook may be coupled to one of the respective panel support frames or the anchor.

BRIEF DESCRIPTION OF THE DRAWINGS

A more complete understanding of the present invention may be acquired by referring to the following description taken in conjunction with the accompanying drawings in which like reference numbers indicate like features and wherein:

FIG. 8 is a schematic drawing showing an isometric view with portions broken away of an energy absorbing element having a plurality of cutouts to minimize damage to a light weight motor vehicle during impact with an energy absorbing assembly;

FIG. 9A is a schematic drawing showing a plan view with portions broken away of another energy absorbing system incorporating teachings of the present invention installed adjacent to a roadside hazard;

FIG. 9B is a schematic drawing showing a plan view with portions broken away after a motor vehicle has collided with or impacted one end of the energy absorbing system of FIG. 9A;

FIG. 9C is a schematic drawing showing a plan view of still another energy absorbing system incorporating teachings of the present invention installed adjacent to one end of a roadside hazard;

FIG. 15 is a schematic drawing showing an isometric view of overlapping panels incorporating teachings of the present invention disposed along one side of the energy absorbing system of FIG. 10;

FIG. 17A is a schematic drawing in section with portions broken away showing a first upstream panel and a second downstream panel slidably disposed relative to each other in accordance with teachings of the present invention;

FIG. 17B is a schematic drawing showing an isometric view of a slot plate satisfactory for use in slidably attaching a panel incorporating teaching of the present invention with a panel support frame;

FIG. 19A is a schematic drawing showing a plan view with portions broken away of an energy absorbing system incorporating teachings of the present invention installed adjacent to one or more roadside hazards;

FIG. 19B is a schematic drawing showing an enlarged plan view with portions broken away of the energy absorbing system of FIG. 19A;

FIG. 19C is a schematic drawing showing an isometric view of a bent plate which may be used to attach side panels to the energy absorbing system of FIG. 19A;

DETAILED DESCRIPTION OF THE INVENTION

Figure 1:
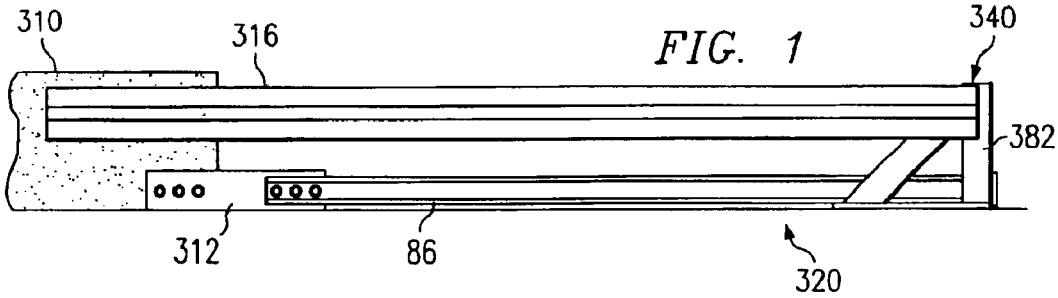
FIG. 1 is a schematic drawing showing an energy absorbing system installed adjacent to one end of a roadside hazard.

The present invention and its advantages are understood by referring to FIGS. 1–31 of the drawings, like numerals being used for like and corresponding parts of the drawings.

Energy absorbing systems 120, 120*a* and 420 incorporating teachings of the present invention may sometimes be referred to as crash cushions, crash barriers, or roadside protective systems. Energy absorbing systems 120, 120*b* and 420 may be used to minimize the results of a collision between a motor vehicle (not expressly shown) and various types of roadside hazards. Energy absorbing systems 120, 120*a* and 420 and other energy absorbing systems incorporating teachings of the present invention may be used for both permanent installation and temporary work-zone applications. Energy absorbing systems 120, 120*a* and 420 and other energy absorbing systems incorporating teachings of the present invention meet or exceed NCHRP Report 350, Test Level 3 requirements.

The terms "longitudinal," "longitudinally" and "linear" will generally be used to describe the orientation and/or movement of components associated with an energy absorbing system incorporating teachings of the present invention in a direction substantially parallel to the direction vehicles (not expressly shown) travel on an adjacent roadway. The terms "lateral" and "laterally" will generally be used to describe the orientation and/or movement of components associated with an energy absorbing system incorporating teachings of the present invention in a direction substantially normal to the direction vehicles travel on an adjacent roadway. Some components of energy absorbing systems 120, 120*a* and 420 may be disposed at an angle (or flare) relative to the direction vehicles travel on an adjacent roadway.

The term "downstream" will generally be used to describe movement which is substantially parallel with and in the same direction as movement of a vehicle traveling an adjacent roadway. The term "upstream" will generally be used to describe movement which is substantially parallel with but in the opposite direction as movement of a vehicle traveling on an adjacent roadway. The terms "upstream" and "downstream" may also be used to describe the position of one component relative to another component in an energy absorbing system incorporating teachings of the present invention.

The terms "separate" and "separating" will generally be used to describe the results of deforming an energy absorbing element using a cutter plate to cause failure of the energy absorbing element in tension in accordance with teachings of the present invention. The terms "separate" and "separating" may also be used to describe the combined effects of ripping and tearing an energy absorbing element in accordance with teachings of the present invention.

The terms "gore" and "gore area" may be used to describe land where two roadway diverge or converge. A gore is typically bounded on two sides by the edges of the roadways which join at the point of divergence or convergence. Traffic flow is generally in the same directions on both sides of these roadways. A gore area often includes shoulders or marked pavement, if any, between the roadways. The third side or third boundary of a gore area may sometimes be defined as approximately sixty (60) meters from the point of divergence or convergence.

The term "roadside hazard" may be used to describe permanent, fixed roadside hazards such as a large sign post, a bridge pillar or a center pier of a bridge or overpass. Roadside hazards may also include a temporary work area disposed adjacent to a roadway or located between two roadways. A temporary work area may include various types of equipment and/or vehicles associated with road repair or construction. The term "roadside hazard" may also include a gore area or any other structure located adjacent to a roadway and presenting a hazard to oncoming traffic.

Various components of an energy absorbing system incorporating teachings of the present invention may be formed from commercially available structural steel materials. Examples of such materials include steel strips, steel plates, structural steel tubing, structural steel shapes and galvanized steel. Examples of structural steel shapes include W shapes, HP shapes, beams, channels, tees, and angles. Structural steel angles may have legs with equal or unequal width. The American Institute of Steel Construction publishes detailed information concerning various types of commercially available steel structural materials satisfactory for use in fabricating energy absorbing systems incorporating teachings of the present invention.

Roadside hazard 310 shown in FIGS. 1, 2, 9A, 9B, 10, and 198 may be a concrete barrier extending along the edge or side of a roadway (not expressly shown). Roadside hazard 310 may also be a concrete barrier extending along the median between two roadways. Roadside hazard 310 may be a permanent installation or a temporary installation associated with a work area. Roadside hazard 310 may sometimes be described as a "fixed" barrier or "fixed" obstacle even though concrete barriers and other obstacles adjacent to a roadway may from time to time be moved or removed. An energy absorbing system incorporating teachings of the present invention is not limited to use with only concrete barriers.

Figure 2:
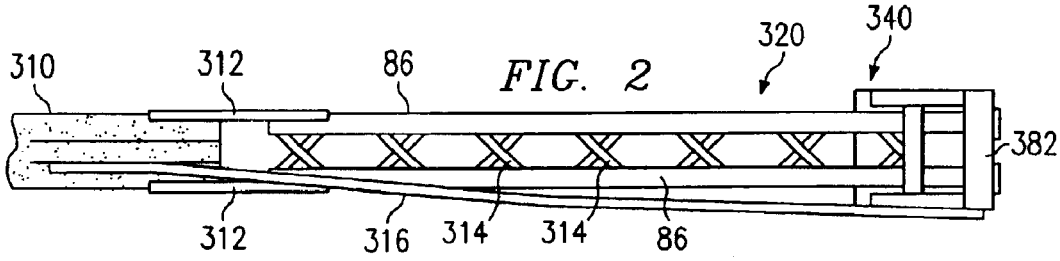
FIG. 2 is a schematic drawing showing a plan view with portions broken away of the roadside hazard and energy absorbing system of FIG. 1.
Figure 3:
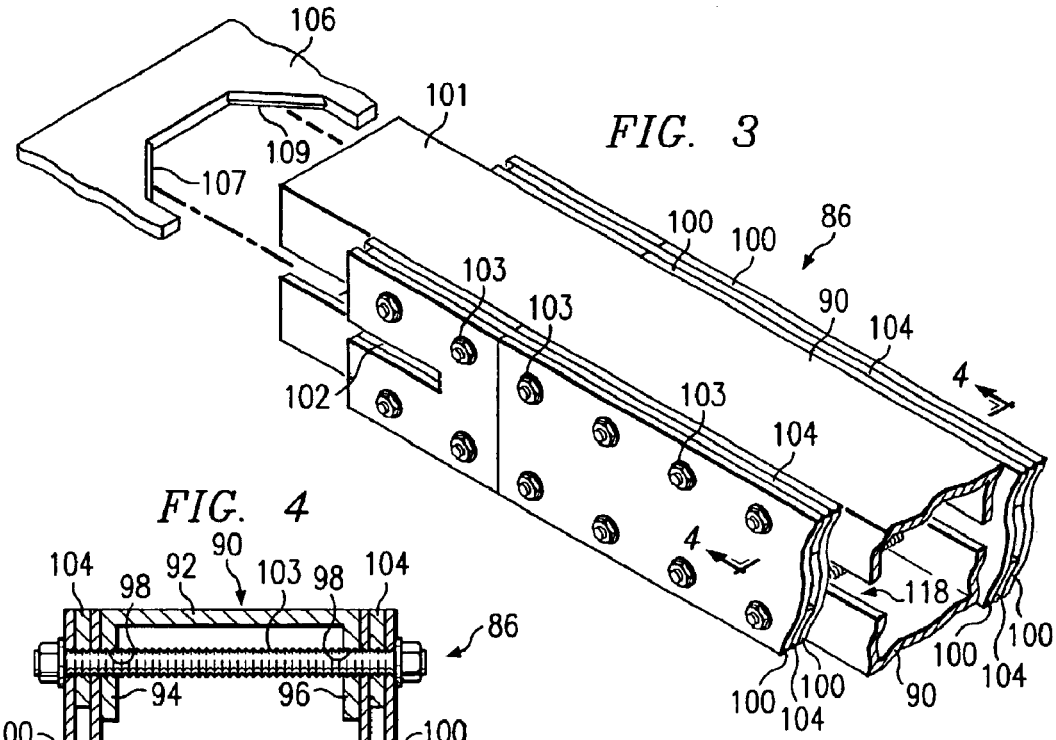
FIG. 3 is a schematic drawing showing an isometric view with portions broken away of a cutter plate and an energy absorbing assembly having a plurality of energy absorbing elements and supporting beams incorporating teachings of the present invention.

Principal components of energy absorbing system 320 as shown in FIGS. 1, 2, and 3 preferably include one or more energy absorbing assemblies 86, cutter plate or plates 106 and sled assembly 340. Cutter plate 106 may also be referred to as a "ripper" or as a "cutter blade." For some applications one end of each energy absorbing assembly 86 may be attached to roadside hazard 310 by respective struts 312. For some applications energy absorbing assemblies 86 may also be fixed to the ground in front of roadside hazard 310. A plurality of spacers or cross braces 314 may be used to hold energy absorbing assemblies 86 aligned generally parallel with each other and extending longitudinally from roadside hazard 310 toward oncoming traffic (not expressly shown).

Sled assembly 340 may be slidably coupled with the end of energy absorbing assemblies 86 opposite from roadside hazard 310. Impact plate 382 may be disposed on the end of sled assembly 340 facing oncoming traffic. One or more of cutter plates 106 (not shown in FIGS. 1 and 2) are preferably provided as part of sled assembly 340. Respective cutter plates 106 are preferably slidably mounted relative to one end of each energy absorbing assembly 86 opposite from roadside hazard 310. When a motor vehicle (not expressly shown) contacts or collides with impact plate 382, sled assembly 340 will move longitudinally relative to energy absorbing assemblies 86 and roadside hazard 310. As sled assembly 340 moves toward roadside hazard 310, kinetic energy of the impacting motor vehicle may be dissipated by cutter plates 106 tearing or ripping associated energy absorbing elements 100.

Figure 4:
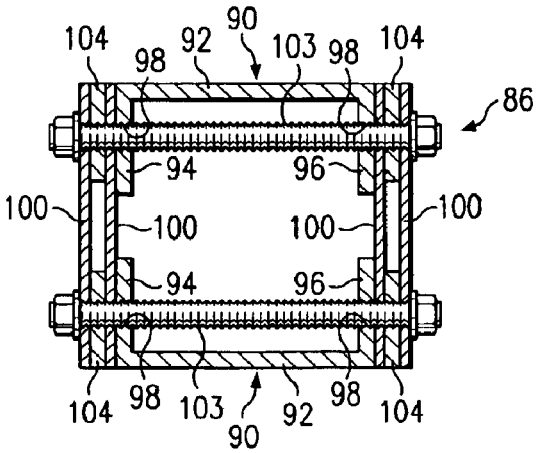
FIG. 4 is a schematic drawing in section with portions broken away taken along lines 4—4 of FIG. 3 showing the box beam type cross section of the energy absorbing assembly.
Figure 5:
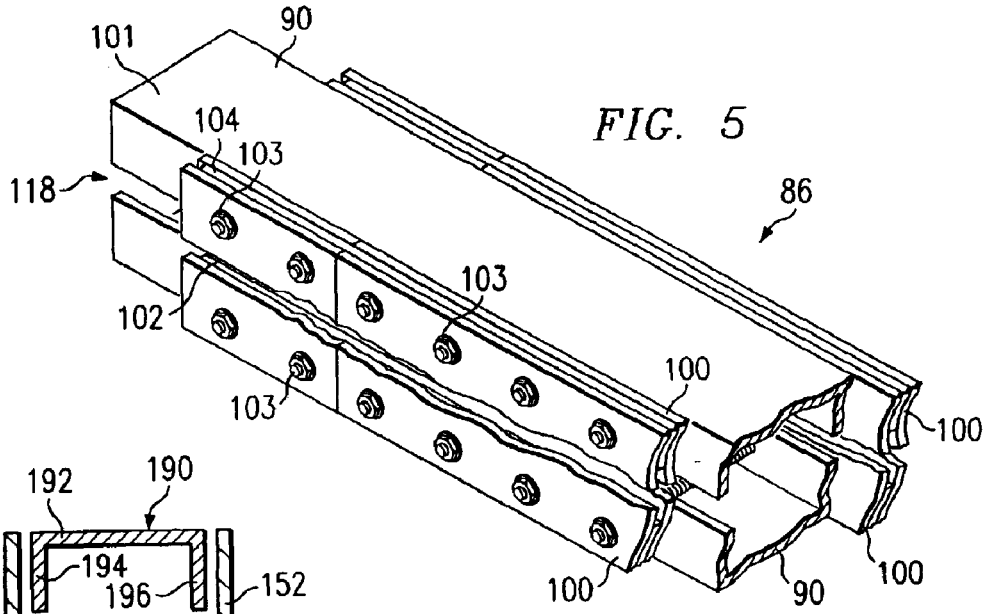
FIG. 5 is a schematic drawing showing an isometric view with portions broken away of the energy absorbing assembly of FIG. 3 after the energy absorbing elements have been cut or ripped while absorbing energy from a vehicle impact.

Energy absorbing assembly 86, as shown in FIGS. 3, 4, and 5 may sometimes be referred to as a "box beam." Each energy absorbing assembly 86 preferably includes a pair of supporting beams 90 disposed longitudinally parallel with each other and are spaced from each other. Supporting beams 90 have a generally C-shaped or U-shaped cross section. The C-shaped cross section of each supporting beam 90 may be disposed facing each other to define a generally rectangular cross section for energy absorbing assembly 86. Supporting beams 90 may also be described as channels. The C-shaped cross section of each support beam 90 may be defined in part by web 92 and grips or flanges 94 and 96 extending therefrom. A plurality of matching holes 98 are preferably formed in both grips 94 and 96 may be used to attach energy absorbing elements 100 to energy absorbing assembly 86. Fasteners 103 preferably allow easy replacement of energy absorbing elements 100 after collision of a motor vehicle with impact plate 382. A wide variety of fasteners may be satisfactorily used to attach energy absorbing elements 100 with supporting beams 90.

For the embodiment shown in FIGS. 3, 4, and 5, a pair of energy absorbing elements 100 may be attached to grips 94 on one side of energy absorbing assembly 86. Another pair of energy absorbing elements 100 may be attached to grips 96 on the opposite side of energy absorbing assembly 86. Spacers 104 are preferably disposed between each pair of energy absorbing elements 100 adjacent to respective grips 94 and 96. A plurality of fasteners 103 extend through holes 98 in grips 94 and 96 and associated energy absorbing elements 100. For some applications, energy absorbing elements 100 have a relatively uniform thickness. For some applications, it may be desirable to vary the thickness and/or number of energy absorbing elements extending along the length of an energy absorbing assembly.

Energy absorbing elements 100 may be formed from various types of metal alloys. For some applications, mild steel may be preferred. The number of energy absorbing elements 100 and their length and thickness may be varied depending upon the intended application for the resulting energy absorbing assembly. Increasing the number of energy absorbing elements, increasing their thickness, and/or increasing the length of energy absorbing elements 100, will allow the resulting energy absorbing assembly to dissipate an increased amount of kinetic energy. Energy absorbing elements 100 may also be referred to as rip plates or shear plates. Benefits of the present invention include the ability to vary the geometric configuration and number of energy absorbing elements 100 and to select appropriate metal alloys depending upon the intended application for the resulting energy absorbing assembly.

For the embodiment shown in FIG. 3, cutter plate 106 includes a pair of beveled cutting edges or ripping edges 107 and 109 disposed at first end 101 of respective energy absorbing assembly 86. Cutting edges 107 and 109 may also be described as rip blades. The thickness of cutter plates 106 and gap 118 between supporting beams 90 are selected to allow cutter plate 106 to fit between grips 94 and 96 and adjacent supporting beams 90.

Slots 102 are preferably formed in the end of each energy absorbing element 100 adjacent to respective cutter plate 106. Cutting edges 107 and 109 are preferably disposed at an acute angle relative to energy absorbing elements 100. For the embodiment shown in FIG. 3, cutting edges 107 and 109 may be hardened and formed at an angle of approximately forty-five degrees relative to associated energy absorbing elements 100. The configuration of cutting edges 107 and 109, including their orientation relative to energy absorbing elements 100, is preferably selected to cause the associated energy absorbing elements 100 to fail in tension as they are stretched between respective grips 94 and 96 of the associated support beams 90.

Energy absorbing elements 100 and other metal components of an energy absorbing system incorporating teachings of the present invention are preferably galvanized to insure that they retain their desired tensile strength and are not affected by environmental conditions which may cause rust or corrosion during the life of the associated energy absorbing system. Specific dimensions of cutting edges 107 and 109, along with their angular relationship relative to energy absorbing elements 100, may be varied depending upon the amount of kinetic energy which will be dissipated by energy absorbing assembly 86.

When a motor vehicle collides with or contacts impact plate or impact fence 382, the force of the collision or impact is generally transmitted to energy absorbing assemblies 86 by cutter plate 106. As sled assembly 340 slides longitudinally toward roadside hazard 310, kinetic energy of an impacting vehicle may be dissipated through cutting or ripping of energy absorbing elements 100 by cutter plate 106 as shown, for example, in FIG. 5.

For relatively low speed impacts, such as between approximately five miles per hour and eighteen miles per hour or higher, one or more relatively short lengths of energy absorbing elements 100 may be installed immediately adjacently to cutter plate 106. Thus, following a low speed impact only relatively short lengths of energy absorbing elements 100 will require replacement which substantially simplifies repair and maintenance of energy absorbing system 320.

As shown in FIG. 2, energy absorbing assemblies 86 are preferably secured to each other by a plurality of cross braces 314. Cooperation between impact fence 382, cross braces 314 and energy absorbing assemblies 86 results in energy absorbing system 320 having a very rigid frame structure. As a result, energy absorbing system 320 is better able to safely absorb impact from a motor vehicle that strikes impact fence 382 either offset from the center of impact fence 382 or that strikes impact fence 382 at an angle other than parallel with energy absorbing assemblies 86.

Figure 6:
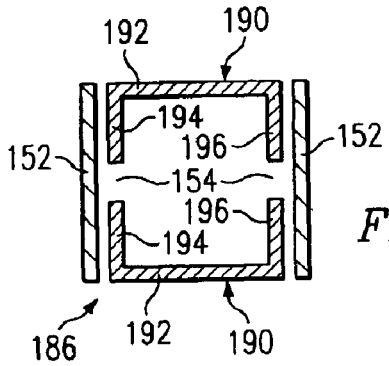
FIG. 6 is a schematic drawing in section with portions broken away showing an energy absorbing assembly incorporating another embodiment of the present invention.
Figure 7:
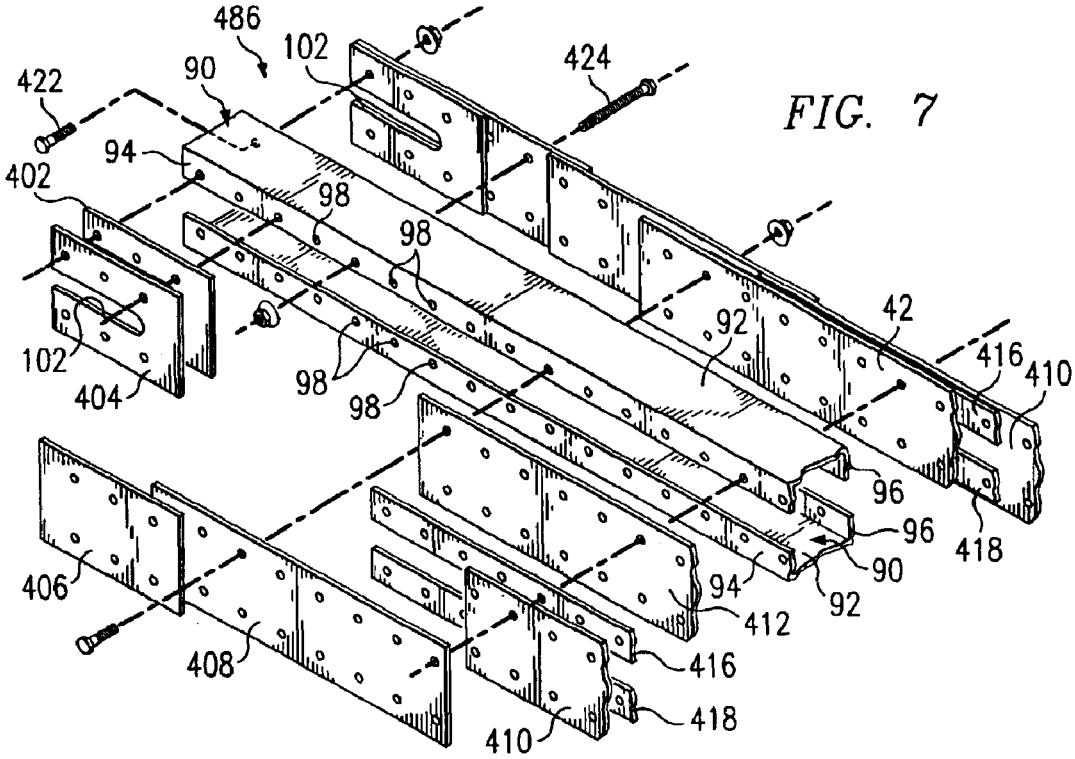
FIG. 7 is an exploded schematic drawing showing an isometric view with portions broken of still another embodiment in which the energy absorbing assembly includes progressively thicker energy absorbing elements along the length of the associated energy absorbing assembly to stop an impacting automobile with a gradually increasing deceleration or stopping force applied to the impacting automobile.

Energy absorbing assemblies 186 and 486 as shown in FIGS. 6 and 7 may be satisfactorily used with any energy absorbing systems incorporating teachings of the present invention. Energy absorbing assembly 186 includes a pair of supporting beams or channels 190 similar to previously described supporting beams 90 for energy absorbing assembly 86. Energy absorbing assembly 186 is shown with only two energy absorbing elements or rip plates 152 disposed on opposite sides thereof. Channels 190 are spaced from each other to define cutting zone or gap 154 therebetween.

Figure 13:
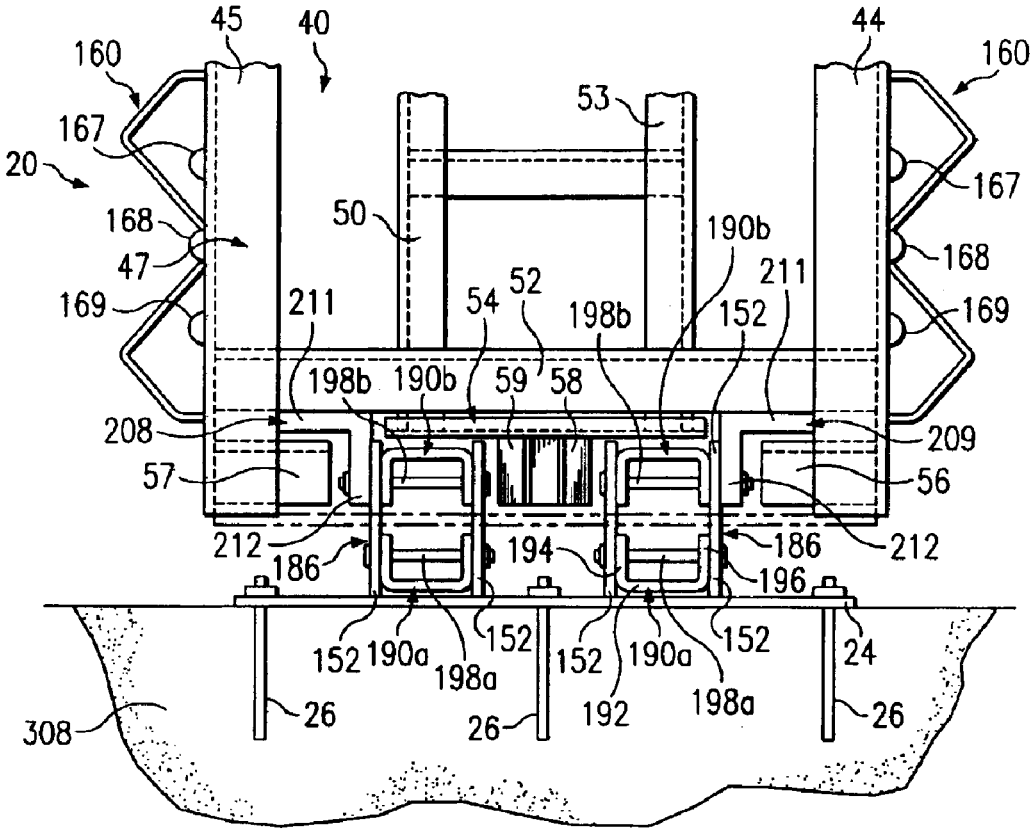
FIG. 13 is a schematic drawing in section with portions broken away showing one end of the sled assembly of FIG. 12 opposite from oncoming traffic.
Figure 14:
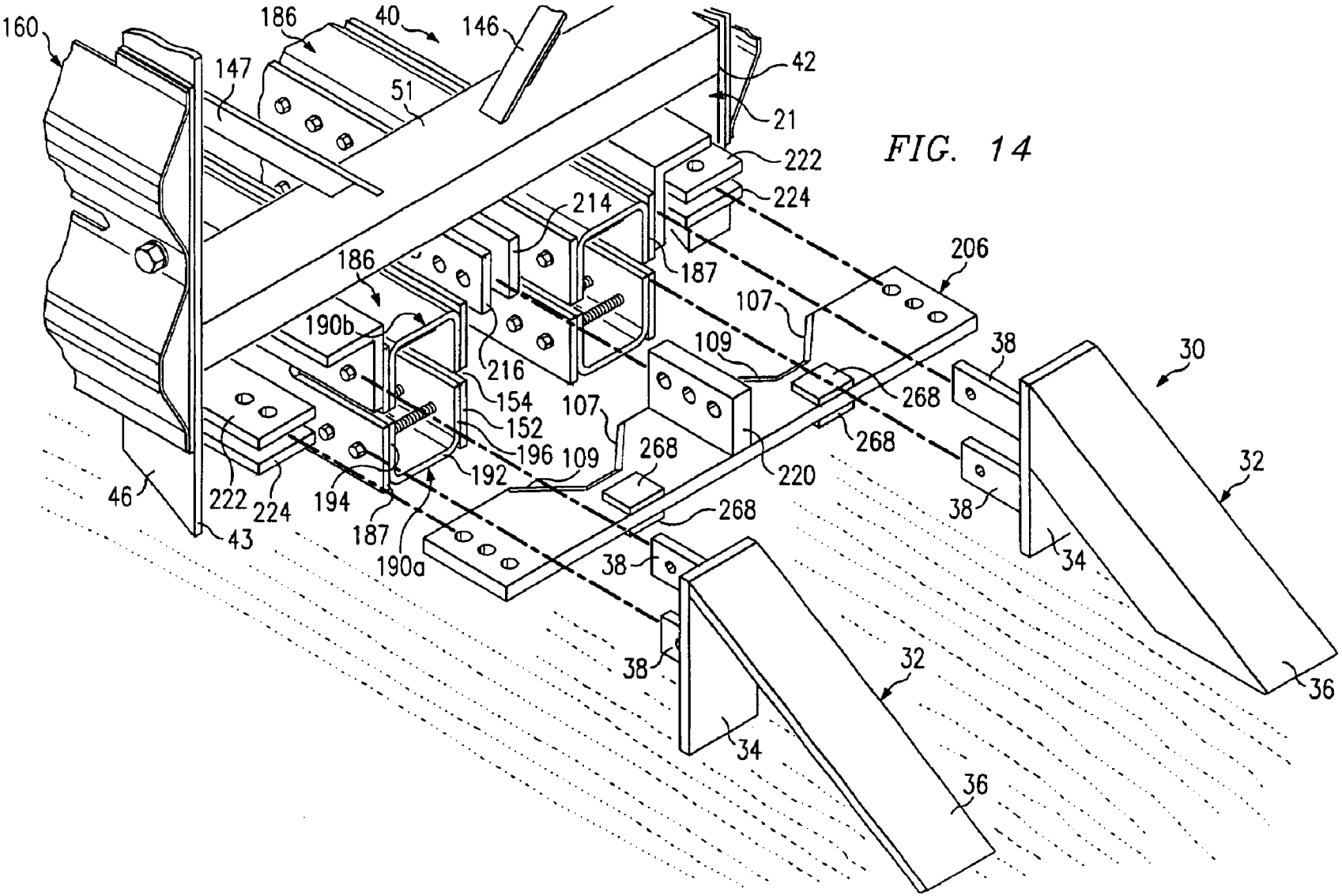
FIG. 14 is a schematic drawing with portions broken away showing an exploded isometric view of the sled assembly, cutter plate and ramp assembly associated with the energy absorbing system of FIG. 10.

Energy absorbing elements 152 may be attached to supporting beams 190 using various types of fasteners including bolts 103 as previously described for energy absorbing assemblies 86. Mechanical fasteners 198*a* and 198*b* as shown in FIGS. 13 and 14 may also be used to attach energy absorbing elements 152 with supporting beams 190. Alternatively, energy absorbing elements 152 may be attached to supporting beams 190 using other types of fasteners such as Huck bolts, rivets, by welding or by various adhesives. One requirement for attaching energy absorbing elements 152 with supporting beams 190 includes providing an appropriately sized cutting zone 154 between supporting beams 190 to accommodate the associated cutter plate (not shown).

FIG. 7 is an exploded schematic drawing showing energy absorbing assembly 486. Some of the differences between energy absorbing assemblies 86 and energy absorbing assembly 486 include variations in the length and thickness of the energy absorbing elements which are replaceably secured to energy absorbing assembly 486. Energy absorbing assembly 486 may be formed using supporting beams 90 as previously described with respect to energy absorbing assembly 86.

For one application, supporting beams or C-channels 90 have an overall length of approximately eleven feet with a web width of approximately five inches and a flange height of approximately two inches. Multiple energy absorbing elements or rip plates 402, 404, 406, 408, 410 and 412 and multiple spacers 416 and 418 are preferably attached to C-channels 90 by threaded fasteners. For the example shown in FIG. 7, the same number and configuration of energy absorbing elements 402, 404, 406 of various lengths and thicknesses are secured on opposite sides of C-channels 90. For one application, energy absorbing elements 402, 404, 406, 408, 410, and 412 were formed from galvanized mild steel plates. The number of energy absorbing elements, their thickness and location on the exterior of energy absorbing assembly 486 may be selected to provide desired deceleration characteristics for various sizes and types of vehicles during both high speed and low speed impacts.

Spacers 416 and 418 may be provided between energy absorbing elements 410 and 412 on both sides of energy absorbing assembly 486. One of the technical benefits of the present invention includes the ability to vary the number, size and location of energy absorbing elements on each side of an energy absorbing assembly to provide desired deceleration characteristics.

Slot 102 is preferably formed in energy absorbing elements 402 and 404 immediately adjacent to the first end of energy absorbing assembly 486 to receive an associated cutter plate. For one application, slot 102 may be formed along the centerline of energy absorbing elements 402 and 404 with an opening of approximately one and one-half inches tapering to a radius of approximately one-half inch in width over a length of approximately six inches.

For some applications, energy absorbing elements 402 and 404 may be replaceably secured with the respective supporting beams 90 by using relatively short mechanical fastener 422. Also, the length of energy absorbing elements 402 and 404 is relatively short in comparison with other energy absorbing elements attached to and forming a part of energy absorbing assembly 486. The use of relatively short mechanical fasteners 422 and relatively short energy absorbing elements 402 and 404 allows energy absorbing assembly 486 to be quickly repaired and returned to service after a relatively minor impact. Mechanical fasteners 424, preferably extend from one side of energy absorbing assembly 486 to the other side of energy absorbing assembly 486. Mechanical fasteners 422 and 424 may be bolts or Hucks as previously described.

Energy absorbing elements 402, 404, 406, 408, 410 and 412 provide deceleration characteristics which may be tailored for specific vehicle weights and speeds. For example, during approximately the first few feet of travel, of an associated cutter plate through energy absorbing assembly 486, two stages of stopping force or deceleration appropriate for a vehicle weighing approximately 820 kilograms are provided. The remaining travel of a cutter plate through energy absorbing assembly 486 provides stopping force that is appropriate for larger vehicles weighing approximately 2,000 kilograms. Variations in the location, size, configuration and number of energy absorbing elements 402, 404, 406, 408, 410 and 412 allows energy absorbing assembly 486 to provide safe deceleration of vehicles weighing between 820 kilograms and 2,000 kilograms.

Energy absorbing element 200 as shown in FIG. 8 has been modified to reduce the initial effects of an impact between a moving vehicle and an energy absorbing system particularly with respect to lightweight vehicles. Oval slots 204 reduce the energy required to initiate ripping or tearing of energy absorbing element 200 on initial impact particularly with respect to a lightweight vehicle. Oval slots 204 cooperate with each other to substantially minimize the initial impact or jolt experienced by a lightweight vehicle colliding with sled assembly 340.

For some applications, center line slot 202 at first end 201 of energy absorbing element 200 may have a width of approximately three quarters of an inch and a length of approximately six inches. Slot 202 may be used to receive cutter plate 206 during installation and align cutter plate 206 with energy absorbing elements 200. A plurality of elongated, oval slots 204 are preferably formed along the center line of energy absorbing element 200 extending from slot 202. For one application, oval slots 204 have a length of approximately two and one half (2½) inches and a width of approximately three quarters (¾) of an inch. The distance between the center line of adjacent oval slots 204 may be approximately three inches. The number of oval slots 204 and the dimensions of oval slots 204 may be varied depending upon intended applications for an associated energy absorbing assembly. For one application, energy absorbing element 200 may have an overall length of forty-five (45) inches and a width of four and one half (4½) inches.

For some applications, energy absorbing element 200 is preferably disposed immediately adjacently to respective cutter plate 106. Limiting the overall length of energy absorbing element 200 to approximately forty-five (45) inches reduces the time and cost of returning an associated energy absorbing system to service following a collision by a lightweight vehicle or a slow speed vehicle with sled assembly 340, if repair is deemed appropriate. After a collision which did not require absorbing a substantial amount of energy, it may only be necessary to replace energy absorbing elements 200 and not all of the other energy absorbing elements attached to an associated energy absorbing assembly 86.

Various types of mechanical fasteners may be satisfactorily used to releasably attach energy absorbing elements 100, 200, and/or 402, 404, 406, 408, 410 and 412 with associated support beams 90. For some applications, a combination of long bolts and short bolts may be satisfactorily used. For other applications, the mechanical fasteners may be blind threaded rivets and associated nuts. A wide variety of blind rivets, bolts and other fasteners may be satisfactorily used with the present invention. Examples of such fasteners are available from Huck International, Inc., located at 6 Thomas, Irvine, Calif. 92718-2585. Power tools satisfactory for installing such blind rivets are also available from Huck International and other vendors.

Figure 10:
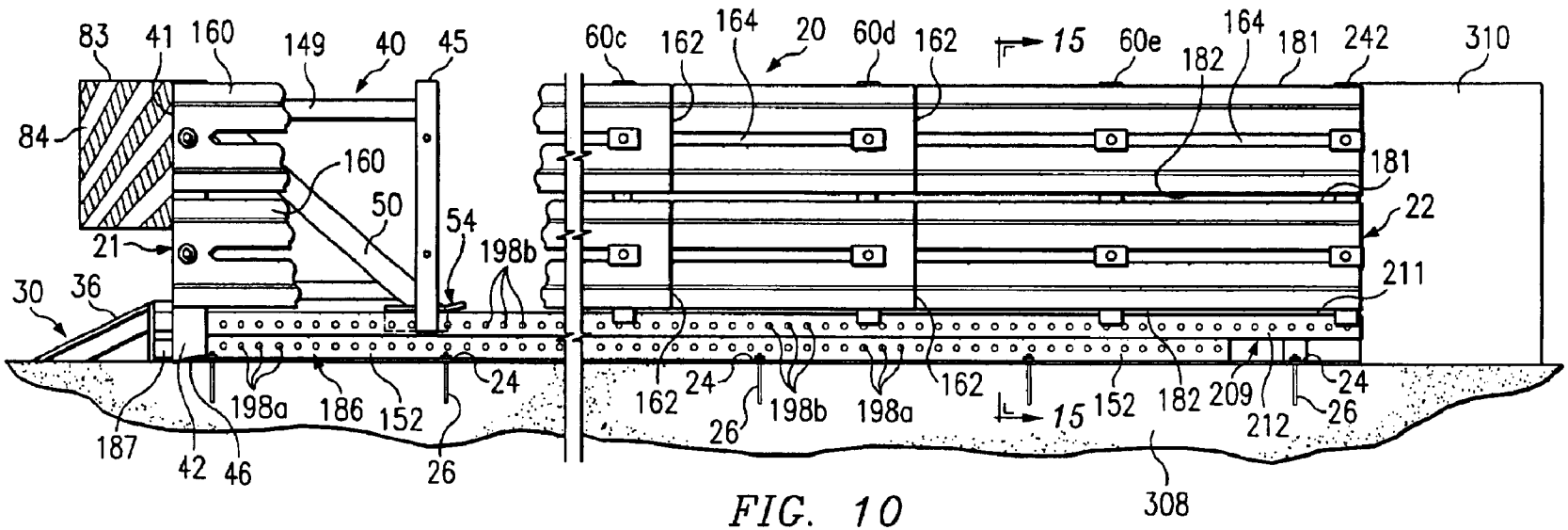
FIG. 10 is a more detailed schematic drawing showing an elevational view with portions broken away of the energy absorbing system of FIGS. 9A and 9B.

Energy absorbing system 20 as shown in FIGS. 9A, 9B and 10 may be installed adjacent to one end of roadside hazard 310 facing oncoming traffic. Portions of energy absorbing system 20 are also shown in FIGS. 11–18. Energy absorbing system 20*a* is also shown in FIG. 9C. Energy absorbing systems 20 and 20*a* may be formed from substantially the same components. Energy absorbing systems 20 and 20*a* may sometimes be described as nongating, redirective crash cushions.

FIG. 9A is a schematic plan view showing energy absorbing system 20 in its first position, extending longitudinally from roadside hazard 310. Sled assembly 40 is slidably disposed at first end 21 of energy absorbing system 20. Sled assembly 40 may sometimes be referred to as an "impact sled." First end 21 of energy absorbing system 20 including first end 41 of sled assembly 40 faces oncoming traffic. Second end 22 of energy absorbing system 20 is preferably securely attached to the end of roadside hazard 310 facing oncoming traffic. Energy absorbing system 20 is generally installed in its first position with first end 21 longitudinally spaced from second end 22 as shown in FIG. 9A.

A plurality of panel support frames 60*a*–60*e* are spaced longitudinally from each other and slidably disposed between first end 21 and second end 22. Panel support frames 60*a*–60*e* may sometimes be referred to as "frame assemblies." The number of panel support frames may be varied depending upon the desired length of an associated energy absorbing system. Multiple panels 160 may be attached to sled assembly 40 and panel support frames 60*a*–60*e*. Panels 160 may sometimes be referred to as "fenders" or "fender panels."

When a vehicle impacts with first end 21 of energy absorbing system 20, sled assembly 40 will move longitudinally toward roadside hazard 310. Energy absorbing assemblies 186 (not expressly shown in FIGS. 9A and 9B) will absorb energy from the impacting vehicle during this movement. Panel support frames 60*a*–60*e* and associated panels 160 will also absorb energy from a vehicle impacting first end 21. FIG. 9B is a schematic plan view which shows sled assembly 40 and panel support frames 60*a*–60*e* and their associated panels 160 collapsed adjacently to each other. Further longitudinal movement of sled assembly 40 toward roadside hazard 310 is prevented by panel support frames 60*a*–60*e*.

For purposes of explanation, the position of energy absorbing system 20 as shown in FIG. 9B may be referred to as the "second" position. During most vehicle collisions with end 21 of energy absorbing system 20, sled assembly 40 will generally move only a portion of the distance between the first position as shown in FIG. 9A and the second position as shown in FIG. 9B.

Panel support frames 60*a*–60*e*, associated panels 160 and other components of energy absorbing system 20 cooperate with each other to redirect vehicles striking either side of energy absorbing system 20 back onto an associated roadway. Respective panels 160 are attached to sled assembly 40 and preferably extend over a portion of respective panels 160 attached to panel support frame 60*a*. In a corresponding manner, panels 160 attached to panel support frame 60*a* preferably extend over a corresponding portion of panels 160 attached to panel support frame 60*b*. Various components of energy absorbing system 20 provide substantial lateral support to panel support frames 60*a*–60*e* and panels 160.

First end 161 of each panel 160 is preferably securely attached to sled assembly 40 or panel support frame 60*a*–60*d* as appropriate. Each panel 160 is also preferably slidably attached to one or more downstream panel support frames 60*a*–60*e*. Up stream panels 160 overlap down stream panels 160 to allow telescoping or nesting of respective panels 160 as panel support frames 60*a*–60*e* slide toward each other. Subsets of panel support frames 60*a*–60*e* and panels 160 may be grouped together to form a one-bay group or a two-bay group.

For purposes of illustration, second end 162 of each upstream panel 160 is shown in FIGS. 9A and 9B projecting a substantial distance laterally at the overlap with the associated downstream panel 160. As discussed later in more detail, panels 160 will preferably nest closely with each other to minimize any lateral projection at second end 162 which might snag a vehicle during a reverse angle impact with either side of energy absorbing system 20.

FIG. 9C is a schematic plan view showing energy absorbing system 20*a* in its first position, extending longitudinally from roadside hazard 310. Energy absorbing system 20*a* includes first end 21 facing oncoming traffic and second end 22 securely attached to roadside hazard 310. Energy absorbing system 20*a* also includes sled assembly 40, panel support frames 60*a*–60*g* and respective panels 160.

Panels 160 extending along both sides of energy absorbing systems 20 and 20*a* may have substantially the same configuration. However, the length of panels 160 may vary depending on whether the respective panel is a "one-bay panel" or a "two-bay panel." For purposes of explanation, a "bay" is defined as the distance between two adjacent panels support frames.

The length of panels 160 designated as "two-bay panels" is selected to span the distance between three-panel support frames when energy absorbing systems 20 and 20*a* are in their first position. For example, first end 161 of a two-bay panel 160 is preferably securely attached to upstream panel support frame 60*a*. Second end 162 of the two-bay panel 160 is preferably slidably attached to downstream panel support frame 60*c*. Another panel support frame 60*b* is slidably coupled with two-bay panels 160 intermediate first end 161 and second end 162.

When sled assembly 40 hits panel support frame 60*a* which may in turn contact panel support frame 60*b* and then 60*c*, etc., the panel support frames 60*a*–60*g* and attached panels 160 are accelerated toward roadside hazard 310. The inertia of panel support frames 60*a*–60*g* and attached panels 160 contributes to the deceleration of an impacting vehicle. If the panel support frame of a one-bay group is hit, the one-bay group will be coupled to its own associated panels 160 and, therefore, will have relatively high inertia. To soften deceleration of an impacting vehicle, a two-bay group is preferably disposed downstream from each one-bay group. When sled assembly 40, or one or more panel support frames being pushed by sled assembly 40, contacts the first panel support frame of a two-bay group (e.g., panel support frame 60*d*), the inertia is the same or slightly more than (because of the longer panels 160) the inertia of a one-bay group. However, when the second panel support frame of the two-bay group (e.g., panel support frame 60*e*) is contacted, the second panel support frame 60 has a lower inertia because it is only slidably coupled to the associated panels 160. Therefore, deceleration is somewhat reduced.

Energy absorbing system 20*a* has the following groups of bays: 2-2-1-2-2, where "2" means two bays and "1" means one bay. Beginning at sled assembly 40 and moving toward roadside hazard 310, energy absorbing system 20*a* has a two-bay group (counting sled assembly 40 as a bay in and of itself), another two-bay group, a one-bay group, followed by a two-bay group and another two-bay group.

As shown in FIG. 10, nose cover 83 may be attached to sled assembly 40 at first end 21 of energy absorbing system 20. Nose cover 83 may be a generally rectangular sheet of flexible plastic type material. Opposite edges of nose cover 83 are attached to corresponding opposite sides of end 41 of sled assembly 40. Nose cover 83 preferably includes a plurality of chevron delineators 84 which are visible to oncoming traffic approaching roadside hazard 310. Various types of reflectors and/or warning signs may also be mounted on sled assembly 40 and along each side of energy absorbing system 20.

Energy absorbing system 20 preferably includes multiple energy absorbing assemblies 186 aligned in respective rows 188 and 189 (See FIG. 18) extending generally longitudinally from roadside hazard 310 and parallel with each other. For some applications, each row 188 and 189 may contain two or more energy absorbing assemblies 186. Energy absorbing assembly 186 in row 188 may be spaced laterally from energy absorbing assembly 186 in row 189.

For some applications, energy absorbing assemblies 186 may be securely attached to concrete foundation 308 in front of roadside hazard 310. Each row 188 and 189 of energy absorbing assemblies 186 has a respective first end 187 which corresponds generally with first end 21 of energy absorbing system 20. First end 41 of sled assembly 40 is also preferably disposed adjacent to first end 187 of rows 188 and 189 prior to a vehicle impact.

Ramp assembly 30 may be provided at end 21 of energy absorbing system 20 to prevent small vehicles or vehicles with low ground clearance from directly impacting first end 187 of rows 188 and 189. If ramp assembly 30 is not provided, a small vehicle or vehicle with low ground clearance may contact either or both first ends 187 and experience severe deceleration with substantial damage to the vehicle and/or injury to occupants in the vehicle.

Various types of ramps and other structures may be provided to ensure that a vehicle impacting end 21 of energy absorbing 20 will properly engage sled assembly 40 and not directly contact first ends 187 of rows 188 and 189. Ramp assembly 30 may include a pair of ramps 32. Each ramp 32 preferably includes leg 34 with tapered surface 36 extending therefrom. Connectors 38 extend from leg 34 opposite from tapered surface 36. Connectors 38 allow each ramp 32 to be securely engaged with respective energy absorbing assembly 186.

For some applications, leg 34 may have a height of approximately six and one-half inches. Other components associated with energy absorbing system 20 such as energy absorbing assemblies 186 and guide rails 208 and 209 will preferably have a generally corresponding height. Limiting the height of ramps 32 and energy absorbing assemblies 186 will allow such components to pass under a vehicle impacting with end 41 of sled assembly 40.

Tapered surfaces 36 may have a length of approximately thirteen and one-half inches. Tapered surfaces 36 may be formed by cutting a structural steel angle (not expressly shown) having nominal dimensions of three inches by three inches by one-half inch thick into sections with appropriate lengths and angles. The sections of structural steel angle may be attached to respective legs 34 using welding techniques and/or mechanical fasteners. Ramps 32 may also be referred to as "end shoes."

Figure 18:
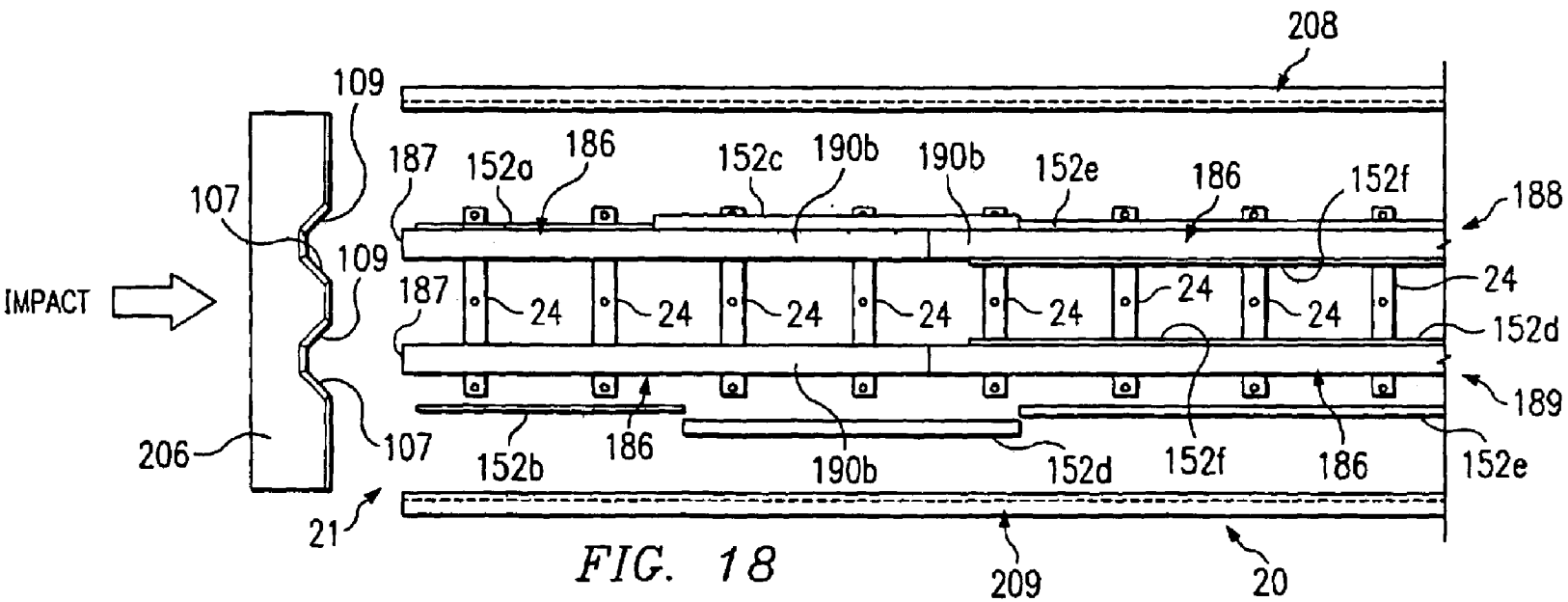
FIG. 18 is a schematic drawing with portions broken away showing an exploded plan view of a cutter plate and energy absorbing elements satisfactory for use with a energy absorbing system incorporating teachings of the present invention.

For some applications, roadside hazard 310 and/or energy absorbing system 20 may be disposed on and attached to a suitable concrete or asphalt foundation. For the embodiment shown in FIGS. 10 and 13 concrete foundation 308 preferably extends both longitudinally and laterally from roadside hazard 310. As shown in FIGS. 13 and 18 energy absorbing assemblies 186 are preferably disposed on and securely attached to a plurality of crossties 24. Each crosstie 24 may be secured to concrete foundation 308 using respective anchor bolts 26. Various types of mechanical fasteners and anchors in addition to anchor bolts 26 may be satisfactorily used to secure crossties 24 with concrete foundation 308. The number of crossties and the number of anchors used with each crosstie may be varied as desired for each energy absorbing system.

Crossties 24 may be formed from structural steel strips having a nominal width of three inches and a nominal thickness of one half inch. The length of each crosstie 24 may be approximately twenty-two inches. Three holes are preferably formed in each crosstie 24 to accommodate anchor bolts 26. During a vehicle collision with either side of energy absorbing system 20, crossties 24 are placed in tension. The materials used to form crossties 24 and their associated configuration are selected to allow crossties 24 to deform in response to tension from such side impacts and to absorb energy from the impacting vehicle.

Energy absorbing assemblies 186 are similar to previously described energy absorbing assemblies 86. For example, see FIGS. 6 and 13. For purposes of describing embodiments shown in FIGS. 9A–18, supporting beams 190 immediately adjacent to crossties 24 are designated 190*a*. The respective supporting beams 190 disposed immediately there above are designated 190*b*. Supporting beams 190*a* and 190*b* have substantially identical dimensions and configurations (See FIG. 13) including respective web 192 with grips or flanges 194 and 196 extending therefrom. Four crossties 24 may be attached to web 192 of supporting beams 190*a* opposite from respective flanges 194 and 196. As a result, the generally C-shaped cross section of each supporting beam 190*a* extends away from respective crossties 24.

The number of crossties 24 attached to each supporting beam 190*a* may be varied depending upon the intended use of the resulting energy absorbing system. For energy absorbing system 20, two supporting beams 190*a* are spaced laterally from each other and attached to four crossties 24. Conventional welding techniques and/or mechanical fasteners (not expressly shown) may be used to attach supporting beams 190*a* with crossties 24.

A plurality of energy absorbing elements 152 are preferably attached to respective supporting beams 190*a* and 190*b* using mechanical fasteners 198*a* and 198*b*. For some applications each energy absorbing element 152 may have substantially the same configuration and dimensions. For other applications such as shown in FIG. 18 energy absorbing elements 152*a*, 152*b*, 152*c*, 152*d*, 152*e* and 152*f* with varying lengths, widths, and thicknesses may be used to form energy absorbing assemblies 186.

A pair of guide rails or guide beams 208 and 209 are preferably attached to and extend laterally from respective supporting beams 190*b*. For some applications, guide rails 208 and 209 may be formed from structural steel angles having legs of equal width such as three inches by three inches and a thickness of approximately one-half of an inch. For other applications, a wide variety of guides may be used. The present invention is not limited to guide rails or guide beams 208 and 209.

Guide rails 208 and 209 each have first leg 211 and second leg 212 which intersect each other at approximately a ninety-degree angle. A plurality of holes (not expressly shown) is preferably formed along the length of second leg 212 to allow attaching guide rails 208 and 209 with mechanical fasteners 198*b* to respective supporting beams 190*b*. Mechanical fasteners 198*b* are preferably longer than mechanical fasteners 198*a* to accommodate guide rails 208 and 209 and longitudinal force causing sled assembly 40 to move toward roadside hazard 310.

As shown in FIG. 10, the length of guide rails 208 and 209 is longer than the length of the associated rows 188 and 189 of energy absorbing assemblies 186. When energy absorbing system 20 is in its second position as shown in FIG. 9B, panel support frames 60*a*–60*e* are disposed immediately adjacently to each other which prevents further movement of sled assembly 40. Therefore, it is not necessary for rows 188 and 189 of energy absorbing assemblies 186 to have the same length as guide rails 208 and 209.

Figure 11:
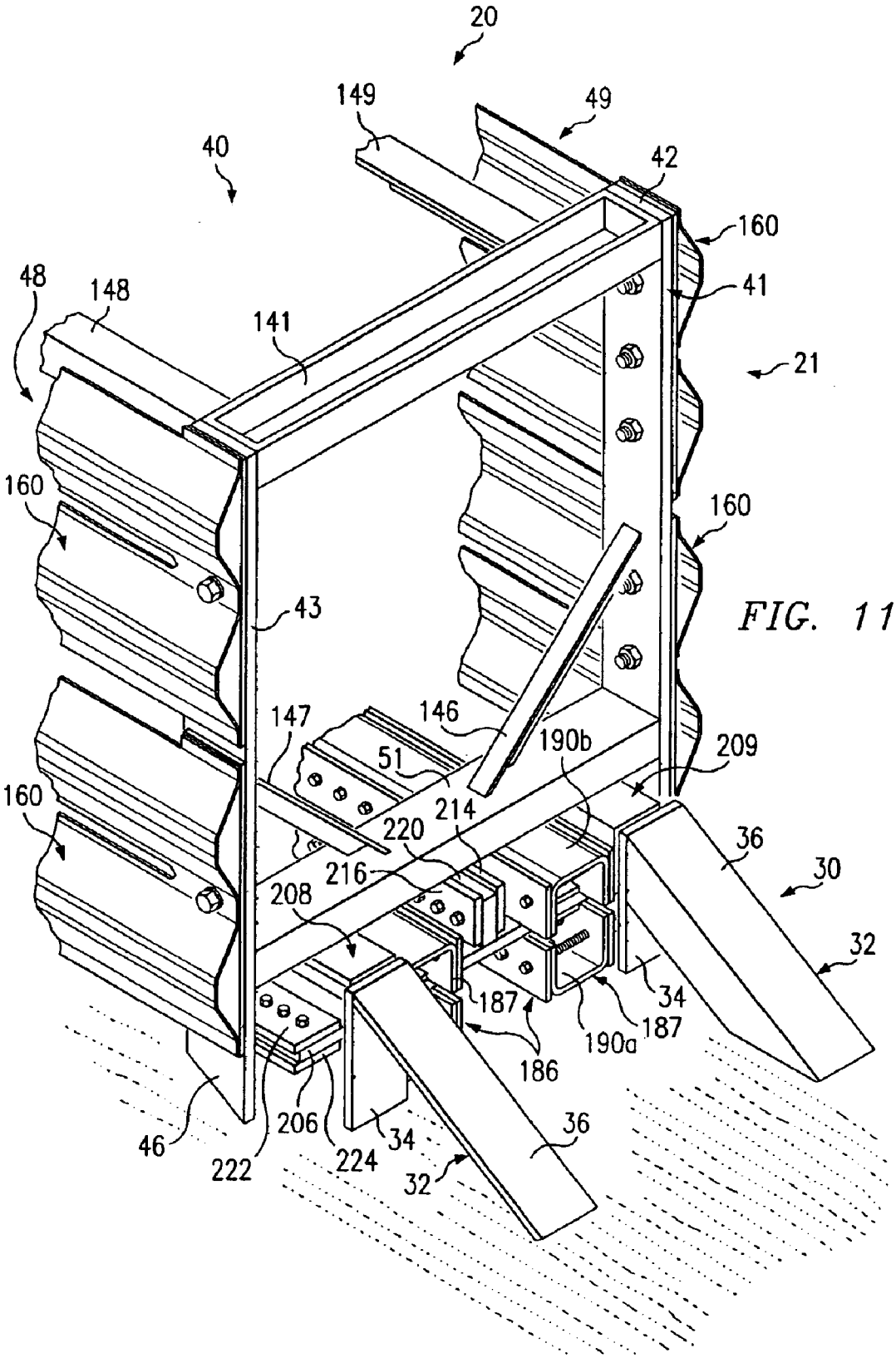
FIG. 11 is a schematic drawing with portions broken away showing an isometric view of a sled assembly and other components at the end of the energy absorbing system of FIG. 10 opposite from the roadside hazard.

Sled assembly 40 may have the general configuration of an open sided box. See FIG. 12. The materials used to form sled assembly 40 and their configuration are preferably selected to allow sled assembly 40 to remain intact after impact by a high speed vehicle. First end 41 of sled assembly 40 corresponds generally with first end 21 of energy absorbing system 20. End 41 may also be referred to as the "upstream" end of sled assembly 40. End 47 of sled assembly 40 is disposed opposite from end 41. End 47 may also be referred to as the "downstream" end of sled assembly 40. Sled assembly 40 also includes sides 48 and 49 which extend between ends 41 and 47. As shown in FIGS. 11 and 13, sides 48 and 49 of sled assembly 40 are preferably covered by panels 160. For purposes of illustration, panels 160 have been removed from side 48 in FIG. 12.

Sled assembly 40 may be further defined by corner posts 42, 43, 44 and 45 which extend generally vertically from guide rails 208 and 209. As shown in FIGS. 10–14, corner posts 42 and 43 may be formed from structural steel strips having a width of approximately four inches, a thickness of approximately three quarters of an inch. Each corner post 42 and 43 has a length of approximately thirty-two inches. Tapered surface 46 is preferably formed on the end of each corner post 42 and 43 immediately adjacent to the ground or concrete foundation 308. The dimensions and configuration of tapered surfaces 46 is preferably selected to minimize or eliminate contact between concrete foundation 308 and respective ends of corner posts 42 and 43 that might prevent smooth, linear movement of sled assembly 40 along guide rails 208 and 209 toward roadside hazard 310.

Corner posts 44 and 45 may be formed from structural steel angles having legs of equal width such as two and one half inches by two and one half inches and a thickness of approximately three-eighths of an inch. Corner posts 44 and 45 preferably have a length of approximately twenty-nine inches. Various configurations of braces and supports may be used to rigidly attach corner post 42, 43, 44 and 45 with each other to provide desired structural strength for sled assembly 40.

Top brace 141 preferably extends laterally between corner posts 42 and 43. Top brace 142 preferably extends laterally between corner posts 44 and 45. A pair of top braces 148 and 149 extend longitudinally between top braces 141 and 142 along respective sides 48 and 49 of sled assembly 40. Bottom brace 51 preferably extends laterally between corner post 42 and corner post 43 immediately above guide rails 208 and 209. Another bottom brace 52 preferably extends laterally between corner post 44 and corner post 45 immediately above guide rails 208 and 209.

End 41 of sled assembly 40 also includes braces 146 and 147 extending diagonally between respective corner posts 42 and 43 and bottom brace 51. Corner posts 42 and 43, top brace 141, bottom brace 51 and braces 146 and 147 cooperate with each other to provide a very rigid, strong structure at first end 41 of sled assembly 40. End 47 of sled assembly 40 includes diagonal braces 143, 144 and 145 along with diagonal braces 146 and 147 to provide additional structural support for sled assembly 40.

The dimensions of end 41 of sled assembly 40 which are defined in part by corner posts 42 and 43, top brace 141 and bottom brace 51 are selected to catch or gather an impacting vehicle. During a collision between a motor vehicle and first end 21 of energy absorbing assembly 20, kinetic energy from the colliding vehicle may be transferred from first end 41 to other components of sled assembly 40. The dimensions and configuration of end 41 may also be selected to effectively transfer kinetic energy even if a vehicle does not impact the center of first end 41 or if a vehicle impacts end 41 at an angle other than parallel with the longitudinal axis of energy absorbing system 20.

A pair of C-shaped channels 50 and 53 preferably extend diagonally from top brace 141 to bottom brace 52. Channels 50 and 53 are preferably spaced laterally from each other and laterally from corner posts 42 and 43 and corner posts 44 and 45. Guide assembly 54 is preferably attached to the ends of channels 50 and 53 extending from bottom brace 52. The length of channels 50 and 53 is selected to ensure that guide assembly 54 will contact web 192 of respective supporting beams 190*b*.

Guide assembly 54 preferably includes plate 55. The end of channels 50 and 53 extending from bottom brace 52 are attached to one side of plate 55. A pair of diverters 58 and 59 are preferably attached to and extend generally vertically from the opposite side of plate 55. Diverters 58 and 59 may be disposed at an angle relative to each other and the center of guide assembly 54 to assist in maintaining sled assembly 40 properly positioned between rows 188 and 189 of energy absorbing assemblies 186. Plate 55 may sometime be referred to as a guide shoe or skid.

Respective tabs 56 and 57 may be attached to the bottom end of corner posts 44 and 45 adjacent to energy absorbing assemblies 186. Tabs 56 and 57 project laterally inward from respective corner posts 44 and 45 toward and under guide rails 208 and 209. Bottom brace 52 is preferably spaced from tabs 56 and 57 such that legs 211 of guide rails 208 and 209 may be respectively disposed between tabs 56 and 57 and bottom brace 52. As shown in FIG. 13, tabs 56 and 57 cooperate with bottom brace 52 to securely maintain sled assembly 40 on guide rails 208 and 209 while at the same time allowing sled assembly 40 to slide along guide rails 208 and 209 toward roadside hazard 310. Tabs 56 and 57 are particularly helpful in preventing undesired lateral rotation of sled assembly 40 in response to a side impact. The inertia of sled assembly 40 and the friction associated with bottom brace 52 sliding over the top of guide rails 208 and 209 and the friction caused by contact between plate 55 and the top of supporting beams 190*b* will contribute to deceleration of the impacting vehicle.

Most impacts between a motor vehicle and end 41 of sled assembly 40 will generally occur at a location substantially above energy absorbing assemblies 186. As a result, vehicle impact with end 41 will generally result in applying a rotational moment to sled assembly 40 which forces bottom brace 52 to bear down on the top of guide rails 208 and 209.

The dimensions of plate 55 and diverters 58 and 59 are selected to be compatible with web 192 of channels 190. During a collision between a motor vehicle and end 41 of sled assembly 40, force from the vehicle is transferred from top brace 141 through channels 50 and 53 to bottom brace 52 and guide assembly 54. As a result, plate 55 will apply force to supporting beams 190*b* to maintain the desired orientation of sled assembly 40 relative to energy absorbing assemblies 186.

Figure 12:
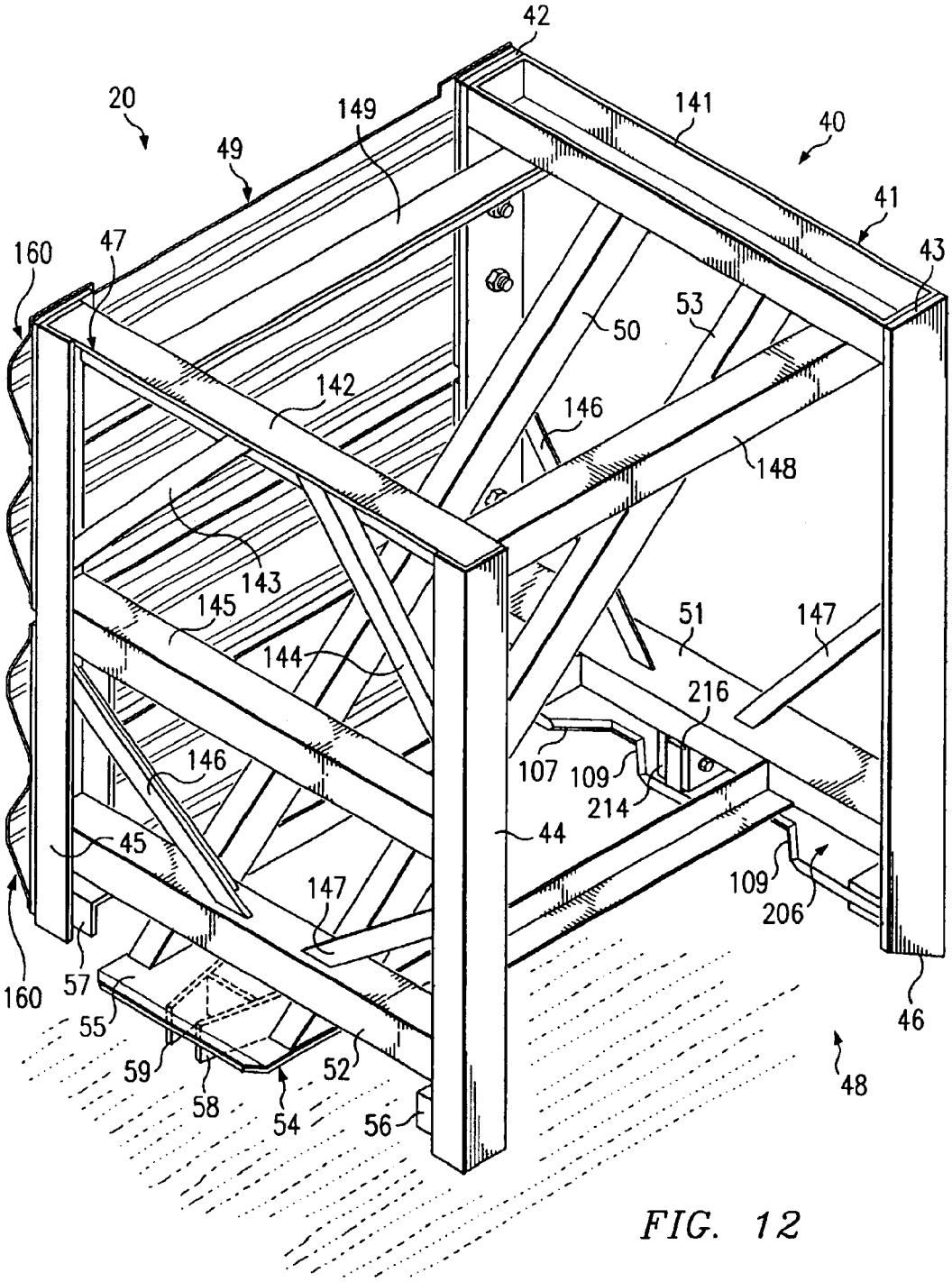
FIG. 12 is a schematic drawing with portions broken away showing an isometric view of the sled assembly associated with the energy absorbing system of FIG. 10.

As shown in FIGS. 11, 12 and 14 connectors 214 and 216 may be attached to bottom brace 51 opposite from cross braces 145 and 146. Connectors 214 and 216 are spaced laterally from each other to receive connector 220 which is attached to and extends from cutter plate 206. Connectors 222 and 224 are also preferably attached to corner post 42 and extend laterally therefrom. Corresponding connectors 222 and 224 are also attached to corner post 43 and extend laterally therefrom. Connectors 222 are spaced from respective connectors 224 a distance corresponding generally with the thickness of cutter plate 206. As shown in FIG. 14, a plurality of holes may be provided in connectors 214, 216, 220, 222, 224 and cutter plate 206 to allow mechanical fasteners to securely attach cutter plate 206 with sled assembly 40 adjacent to energy absorbing assemblies 186.

As shown in FIGS. 12, 14 and 18 cutter plate 206 preferably includes two sets of beveled cutting edges or ripping edges 107 and 109. Sled assembly 40 may be slidably disposed on guide rails 208 and 209 with cutting edges 107 and 109 aligned with first end 187 of energy absorbing assemblies 186. The thickness of cutter plate 206 and the gap or cutting zone 154 between supporting beams 190*a* and 190*b* are selected to allow cutter plate 206 to fit between flanges 194 and 196 of supporting beams 190*a* and 190*b*. Cutter plate 206 may be located within slots 102 of energy absorbing assemblies 186.

As shown in FIG. 14, cutter plate 206 preferably includes respective guide plates 268. A respective guide plate 268 may be provided on each side of cutter plate 206 for each supporting beam 190. The width of each guide plate 268 is selected to be compatible with the width of the respective supporting beam 190. The combined thickness of each cutter plate 206 along with respective guide plates 268 is selected to be compatible with gap or cutting zone 154 formed between respective support beams 190. The thickness of cutting plate 206 is selected to correspond generally with the dimensions of gap 154. Each guide plate 268 is preferably disposed within the generally C-shaped cross section defined by web 192 and flanges 194 and 196 of the associated support beams 190. For some applications, gap or cutting zone 154 between supporting beams 190*a* and 190*b* may be approximately one inch (or twenty-five millimeters) and the thickness of cutter plates 206 may be approximately one half inch.

During a collision with end 21 of energy absorbing system 20, a vehicle will experience a deceleration spike as momentum is transferred from the vehicle to sled assembly 40 which results in sled assembly 40 and the vehicle moving in unison with each other. The amount of deceleration due to the momentum transfer is a function of the weight of sled assembly 40, along with the weight and initial speed of the vehicle. As sled assembly 40 slides longitudinally toward roadside hazard 310, guide assembly 54 will contact respective supporting beams 190*a* and 190*b* to maintain the desired alignment between sled assembly 40 and energy absorbing assemblies 186 and cutter plates 206. Sled assembly 40 maintains cutter blade 206 in alignment with cutting zone 154.

As sled assembly 40 continues sliding toward roadside hazard 310, cutter plate 206 will engage and separate energy absorbing elements 152 of the respective energy absorbing assemblies 186. When sled assembly 40 is impacted by a vehicle, cutter plate 206 is pushed into the edge of each energy absorbing element 152. Beveled edges 107 and 109 of cutter plate 206 engage respective energy absorbing elements 152. Cutter plate 206 may be formed from various steel alloys. Beveled edges 107 and 109 are preferably hardened to provide desired cutting and/or ripping of energy absorbing elements 152.

The center portion of each energy absorbing element 152 may be forced inwardly between respective supporting beams 190, while the top and bottom portions of each energy absorbing element 152 remains fixed to respective supporting beams 190 by bolts 198*a* and 198*b*. The center portion of each energy absorbing element 152 continues to be stretched or deformed by cutter plate 206 until respective energy absorbing element 152 typically fails in tension. This creates a separation in each energy absorbing element 152 which propagates along the length of respective energy absorbing elements 152 as sled assembly 40 continues to be push cutter plate 206 therethrough.

The separation of energy absorbing elements 152 will stop when kinetic energy from the impacting vehicle has been absorbed. After the passage of cutter plate 206, one or more energy absorbing elements 152 will be separated into upper and lower parts (See FIG. 5), which upper and lower parts are separated by a gap.

Cutter plate 206, when viewed from associated energy absorbing elements 152, has the configuration of a deep, strong beam. Cutter plate 206 is secured to sled assembly 40 at both ends and in the center and is therefore rigid. Thus, when cutter plate 206 engages energy absorbing elements 152, the energy absorbing elements 152 fails while cutter plate 206 does not.

As previously noted, the thickness and number of energy absorbing elements 152 may be varied to safely absorb the kinetic energy from a wide range of vehicle types, sizes and/or speeds of impact. The rotational moment which is generally applied to end 41 of sled assembly 40 will also increase frictional forces between cutter plate 206 and portions of energy absorbing element 152 which have been sheared or ripped.

For many applications, energy absorbing elements disposed immediately adjacently to sled assembly 40 will typically be relatively thin or "soft" to decelerate relatively small, slow-moving vehicles. The length of respective rows 188 and 189 associated with energy absorbing systems 20, 120, 120*a*, and 420 are preferably selected to be long enough to provide multiple stages for satisfactory deceleration of large, high-speed vehicles after sled assembly 40 has moved through the front portion with "relatively soft" energy absorbing elements. Generally, energy absorbing elements installed in the middle portion of rows 188 and 189 and immediately adjacent to the end of each row will be relatively "hard" as compared to energy absorbing elements installed adjacent to first end 21.

When a vehicle initially impacts first end 41 of sled assembly 40 facing oncoming traffic, any occupants who are not wearing a seat belt or other restraining device will be catapulted forward from their seat. Properly restrained occupants will generally decelerate with the vehicle. During the short time period and distance sled assembly 40 travels along guide rails 208 and 209, an unrestrained occupant may be airborne inside the vehicle. Deceleration forces applied to the impacting vehicle during this same time period may be quite large. However, just prior to an unrestrained occupant contacting interior portions of the vehicle, such as the windshield (not expressly shown), deceleration forces applied to the vehicle will generally be reduced to lower levels to minimize possible injury to the unrestrained occupant.

For the embodiment as shown in FIG. 9A, end 47 of sled assembly 40 will contact panel support frame 60*a* which will, in turn, contact panel support frame 60*b* and any other panel support frames disposed downstream from sled assembly 40. Movement of sled assembly 40 toward roadside hazard 310 results in telescoping of panel support frames 60*a*–60*e* and their associated panels 160 with respect to each other. The inertia of panel support frames and their associated panels 160 will further decelerate an impacting vehicle as sled assembly 40 moves longitudinally from first end 21 toward second end 22 of energy absorbing system 20. The telescoping or sliding of panels 160 against one another produces additional friction forces which also contribute to deceleration of the vehicle. Movement of panel support frames 60*a*–60*e* along guide rails 208 and 209 also produces additional frictional forces to even further decelerate the vehicle.

As previously discussed with respect to FIGS. 9A and 9B, panel support frames 60*a*–60*e* and associated panels 160 will redirect vehicles striking either side of energy absorbing system 20 back onto the associated roadway. Each panel 160 preferably has a generally elongated rectangular configuration defined in part by first end or upstream end 161 and second end or downstream end 162. (See FIGS. 9A, 10 and 15.) Each panel 160 preferably includes first edge 181 and second edge 182 which extend longitudinally between first end 161 and second end 162. (See FIGS. 10 and 15.) For some applications panels 160 may be formed from standard ten (10) gauge W beam guardrail sections having a length of approximately thirty-four and three-fourth inches for "one-bay panels" and five feet two inches for "two-bay panels." Each panel 160 preferably has approximately the same width of twelve and one-fourth inches.

As shown in FIGS. 10 and 15, respective slot 164 is preferably formed in each panel 160 intermediate ends 161 and 162. Slot 164 is preferably aligned with and extends along the longitudinal center line (not expressly shown) of each panel 160. The length of slot 164 is less than the length of the associated panel 160. A respective slot plate 170 is slidably disposed in each slot 164.

Metal strap 166 may be welded to first end 161 of each panel 160 along edges 181 and 182 and the middle. See FIG. 16. For some applications metal strap 166 may have a length of approximately twelve and one-fourth inches and a width of approximately two and one-half inches. The length of each metal strap 166 is preferable equal to the width of the respective panel 160 between respective longitudinal edges 181 and 182.

Mechanical fasteners 167, 168, and 169 may be used to attach each metal strap 166 with its associated corner post 68 or 69. Mechanical fasteners 167 and 169 are substantially identical. Metal straps 166 provide more contact points for mounting end 161 of panels 160 to respective panel support frames 60*a*–60*f*.

Recesses 184 are preferably formed in each panel 160 at the junction between second end 162 and respective longitudinal edges 181 and 182. (See FIG. 15) Recesses 184 allow panels 160 to fit with each other in a tight overlapping arrangement when energy absorbing system 20 is in its first position. As a result, recesses 184 minimize the possibility of a vehicle snagging the sides of energy absorbing system 20 during a "reverse angle" collision or impact.

Panel support frames 60*a*–60*e* may have substantially the same dimensions and configuration. Therefore, only panel support frame 60*e* will be described in detail. See FIG. 16. For some applications panel support frame 60*e* has a generally rectangular configuration defined in part by first post 68 disposed adjacent to guide rail 208 and second post 69 disposed adjacent to guide rail 209. Top brace 61 extends laterally between first post 68 and second post 69. Bottom brace 62 extends laterally between first post 68 and second post 69. The length of posts 68 and 69 and the location of bottom brace 62 are selected such that when panel support frame 60*e* is disposed on guide rails 208 and 209, bottom brace 62 will contact guide rails 208 and 209 but posts 68 and 69 will not contact concrete foundation 308.

A plurality of cross braces 63, 64, 65, 70 and 71 may be disposed between posts 68 and 69, top brace 61 and bottom brace 62 to provide a rigid structure. For some applications cross braces 63, 64, 65, 70 and 71 and/or posts 68 and 69 may be formed from relatively heavy structural steel components. Also, cross brace 65 may be installed at a lower position on posts 68 and 69. The weight of support frames 60*a*–60*e* and the location of the associated cross braces may be varied to provide desired strength during a side impact with energy absorbing system 20.

Tab 66 is attached to the end of post 69 adjacent to concrete foundation 308 and extends laterally toward energy absorbing assemblies 186. Tab 67 is attached to the end of post 68 adjacent to concrete assembly 308 and extends laterally toward energy absorbing assemblies 186. Tabs 66 and 67 cooperate with bottom brace 62 to maintain panel supporting frame 60*e* engaged with guide rails 208 and 209 during a side impact with energy absorbing system 20.

Impact from a vehicle colliding with either side of energy absorbing assembly 20 will be transferred from panels 160 to panel support frames 60*a*–60*g*. The force of the lateral impact will then be transferred from panel support frames 60*a*–60*g* to the associated guide rails 208 and/or 209 to energy absorbing assemblies 186 through crossties 24 and mechanical fasteners 26 to concrete foundation 308.

Crossties 24, mechanical fasteners 26, energy absorbing assemblies 186, guide rails 208 and 209 along with panel support frames 60*a*–60*g* provides lateral support during a side impact with energy absorbing system 20.

For purposes of explanation, panels 160 shown in FIG. 15 have been designated 160*a*, 160*b*, 160*c*, 160*d*, 160*e* and 160*f*. Further, the longitudinal edges of panels 160*a*–160*d* are identified as longitudinal edges 181*a*–181*d* and 182*a*–182*d*, and the longitudinal edges of panel 160*f* are identified as longitudinal edges 181*f* and 182*f*. Also, for panels 160*a*, 160*b*, and 160*d*, ends 161 and 162 are identified as ends 161*a* and 162*a*, ends 161*b* and 162*b*, and ends 161*d* and 162*d*, respectively. Likewise, for panel 160*c*, the upstream end is identified as end 161*c*; and for panel 160*e*, the downstream end is identified as end 162*e*. As shown in FIGS. 15 and 17A, respective metal straps 166 may be attached to first end 161*a* and first end 161*d* to post 68 of panel support frame 60*c*. In a similar manner, respective metal straps 166 are provided to securely attach first end 161*b* and 161*e* to corner post 68 of panel support frame 60*d*. As shown in FIGS. 17A and 17B, bolt 168 extends through hole 172 in respective slot plate 170 and a corresponding hole (not expressly shown) in panel 160*b*.

As shown in FIG. 17, slot plate 170 preferably includes hole 172 extending therethrough. A pair of fingers 174 and 176 extend laterally from one side of slot plate 170. Fingers 174 and 176 are sized to be received within slot 164 of the associated panel 160. Mechanical fastener 168 is preferably longer than mechanical fasteners 167 and 169 to accommodate slot plate 170. Each slot plate 170 and bolt 168 cooperate with each other to securely anchor end 161 of an inner panel 160 with the associate post 68 or 69 while allowing an outer panel 160 to slide longitudinally relative to the associated post 68 or 69. See inner panel 160*b* and outer panel 160*a* in FIG. 17A.

A portion of each bolt 168 along with associated fingers 174 and 176 of slot plate 170 may be slidably disposed in respective slot 164 of each panel 160. During a vehicle impact with end 21 of energy absorbing assembly 20, panel support frame 60*c* with first end 161*a* of panel 160*a* will move longitudinally toward roadside hazard 310. The engagement of the associated slot plate 170 within longitudinal slot 164 will allow panel 160*a* to slide longitudinally relative to panel 160*b* until panel support frame 60*c* contacts panel support frame 60*d*. When this contact occurs, panel support frame 60*d* and associated panels 160 will move with panel support frame 60*c* and its associated panels 160 toward roadside hazard 160.

Relative "softness" or "hardness" of an energy absorbing system may be determined by the number and characteristics of energy absorbing elements 152, the location of energy absorbing elements 152, and the location and inertia associated with panel support frames 60*a*–60*g* and their associated panels 160. For example, energy absorbing element 200 shown in FIG. 8 may be modified to be relatively hard by reducing the number and/or size of oval slot 204. In the same manner, energy absorbing element 200 may be made relatively soft by increasing the number and/or size of oval slot 204. Increasing the thickness of energy absorbing elements 152 will increase the amount of force required to push cutter plate 206 therethrough and thus, produces a harder portion in the associated energy absorbing system. Energy absorbing assembly 486 as previously described in FIG. 7 shows various techniques for increasing the hardness of an energy absorbing system.

Energy absorbing system 20 as shown in FIG. 18 preferably includes energy absorbing elements 152*a*, 152*b*, 152*c*, 152*d*, 152*e* and 152*f*. Energy absorbing elements 152*a* and 152*b* are preferably formed from relatively thin sixteen gauge construction steel strips having a nominal width of four and one half inches. Energy absorbing element 152*a* preferably has a nominal length of approximately fifty-four inches. Energy absorbing element 152*b* preferably has a nominal length of approximately sixty inches. Energy absorbing elements 152*c* and 152*d* are preferably formed from structural steel strips having a nominal width of four and one half inches and thickness of three-sixteenths of an inch. Energy absorbing element 152*c* preferably has a nominal length of approximately seventy-six inches. Energy absorbing element 152*d* preferably has a nominal length of approximately seventy inches. Energy absorbing elements 152*e* are preferably formed from the same type of material. Energy absorbing elements 152*f* are preferably formed from structural steel strips having a width of approximately four and one-half inches and a length of approximately ninety-two inches. Each energy absorbing element 152*f* preferably has a thickness corresponding with ten gauge construction steel strips.

Various components and features of energy absorbing systems 320 and 20 such as energy absorbing assemblies 86, 186 and 486 and energy absorbing elements 100, 152, 200, 402, 404, 406, 408, 410 and 412 may be incorporated into energy absorbing systems 120, 120*a* and 420 as desired. Energy absorbing systems 120, 120*a* and 420 may dissipate kinetic energy by ripping or tearing respective energy absorbing elements. However, other types of energy absorbing assemblies may be satisfactorily used with an energy absorbing system having flared sides and/or wing extensions formed in accordance with teachings of the present invention.

Figure 24:
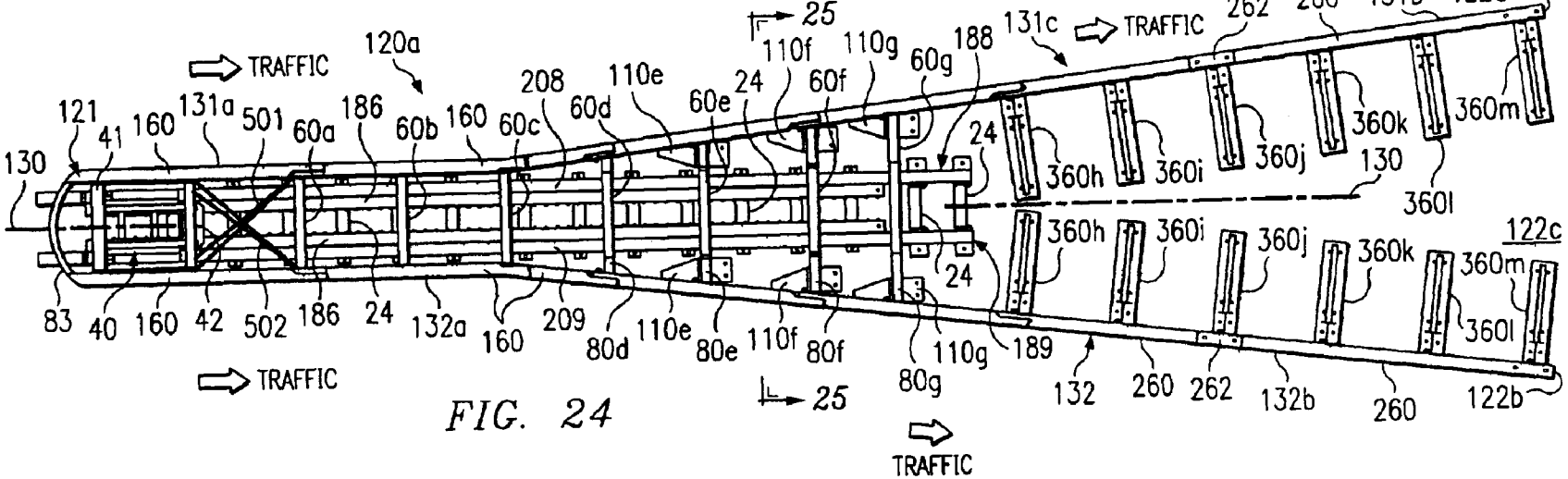
FIG. 24 is a schematic drawing showing a plan view of an energy absorbing system having a generally symmetrical configuration formed in accordance with teachings of the present invention.
Figure 25:
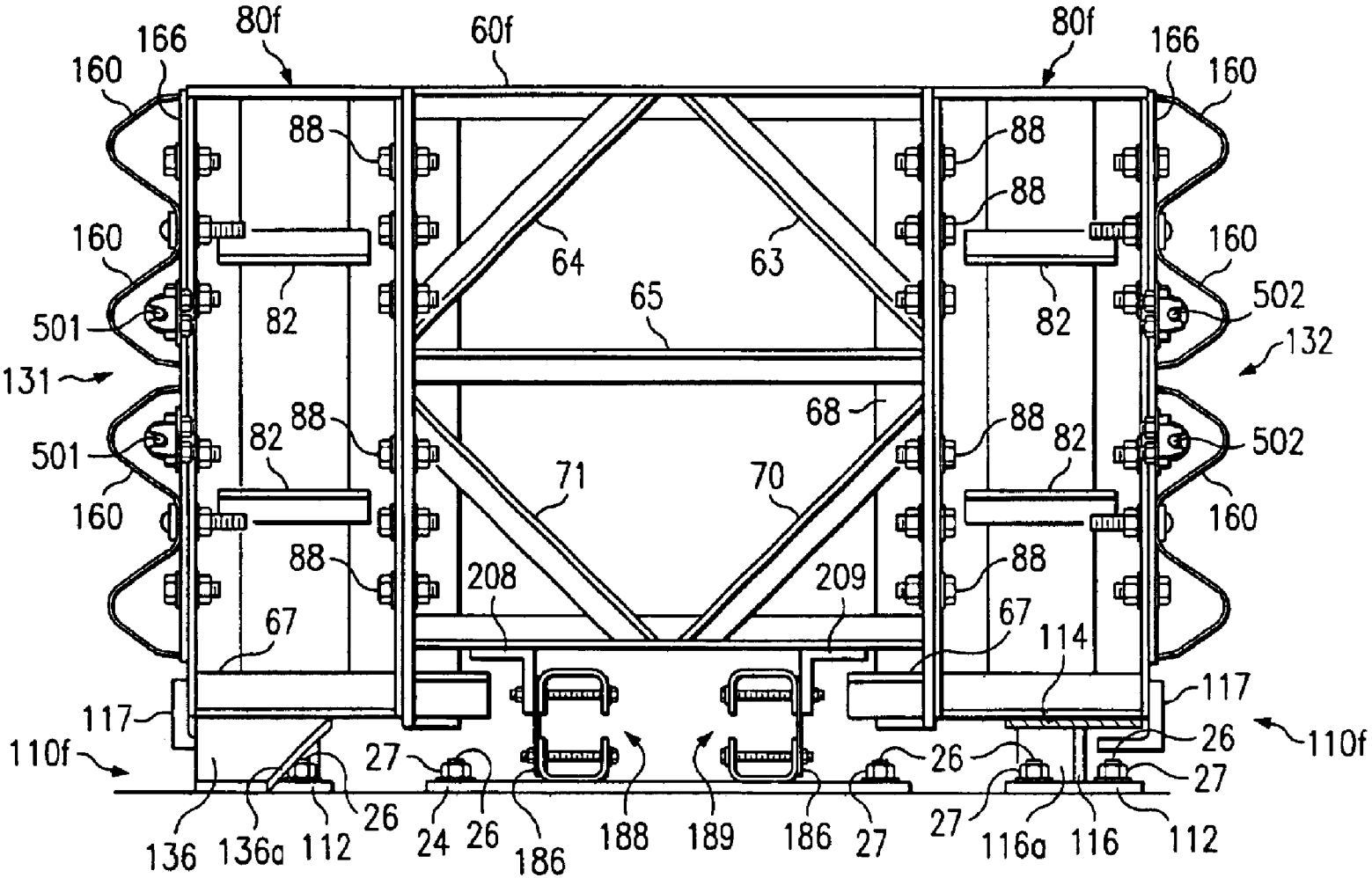
FIG. 25 is a schematic drawing in section taken along lines 25—25 of FIG. 24.
Figure 26:
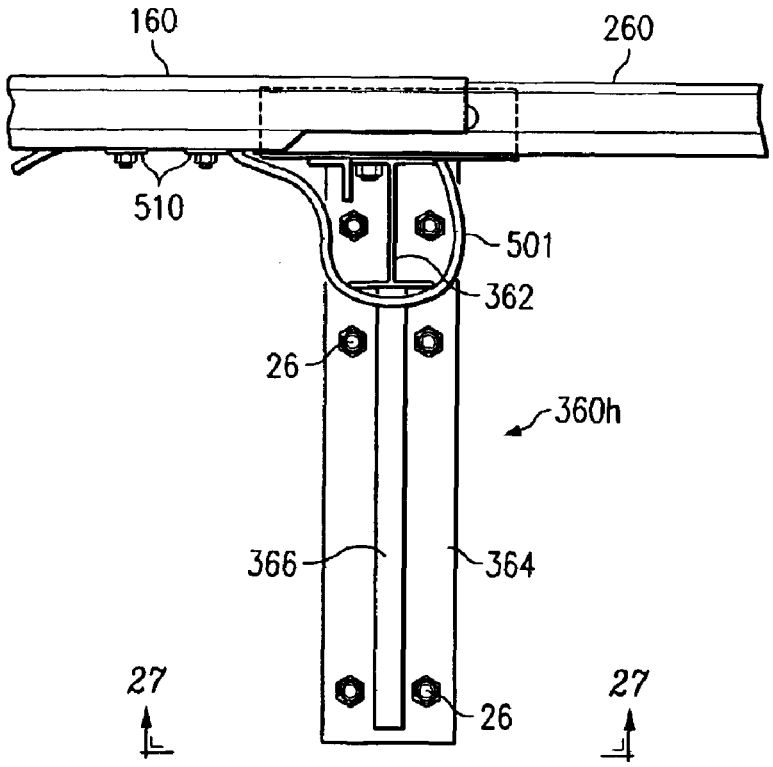
FIG. 26 is a schematic drawing showing a plan view of a transition between panels which may slide relative to each other and panels which do not slide relative to each other during a vehicle impact.
Figure 27:
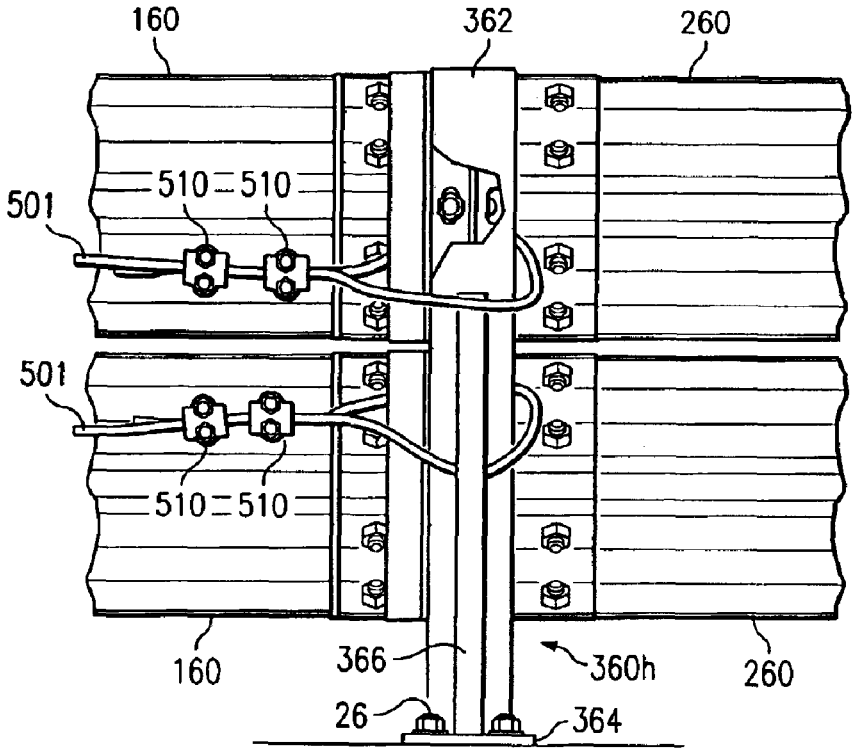
FIG. 27 is a schematic drawing in elevation with portions broken away taken along lines 27—27 of FIG. 26.
Figure 30:
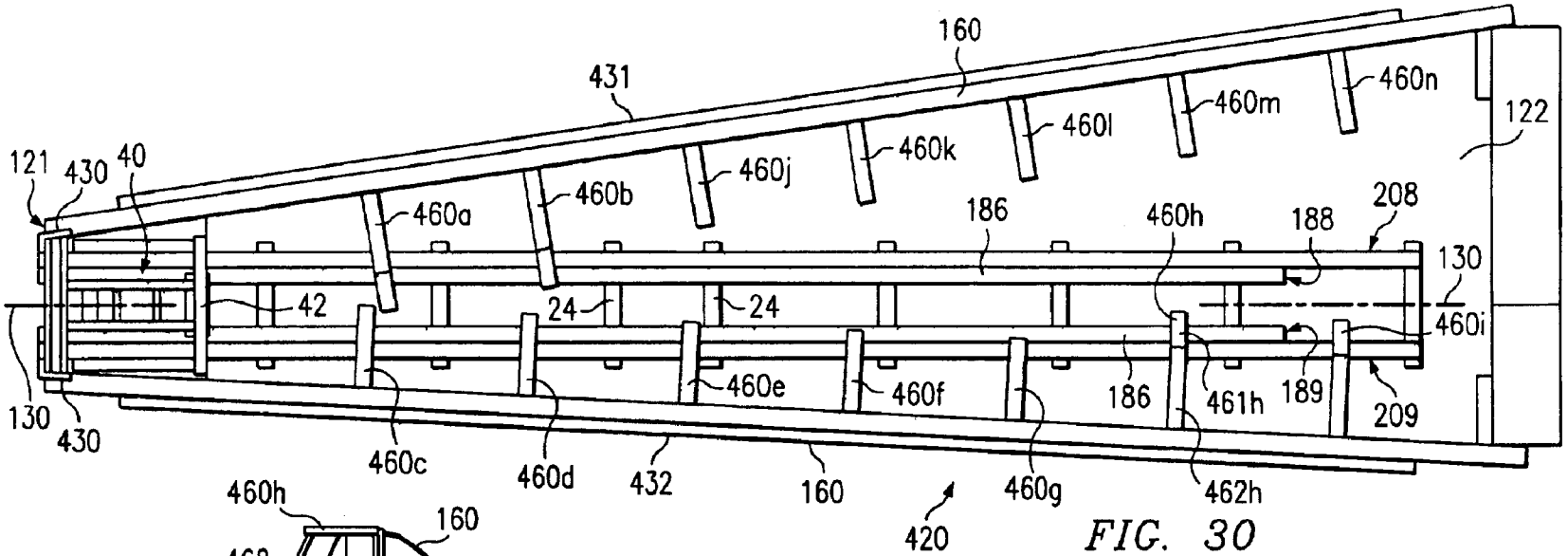
FIG. 30 is a schematic drawing showing a plan view with portions broken away of still another energy absorbing system having a generally asymmetrical configuration incorporating teachings of the present invention.
Figure 31:
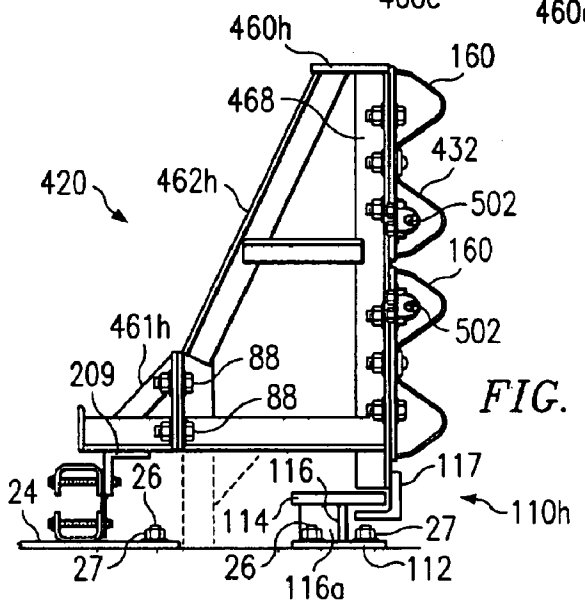
FIG. 31 is a schematic drawing in section with portions broken away showing one example of a split panel support frame and an outboard anchor assembly incorporating teachings of the present invention.

Energy absorbing system 120, shown in FIGS. 19A–23 incorporating teachings of the present invention, may be installed adjacent to a relatively wide or large roadside hazard facing oncoming traffic. Energy absorbing system 120*a* incorporating a further embodiment of the present invention is shown in FIGS. 24 and 25. Various components which may be used with energy absorbing systems 120 and 120*a* are shown in FIGS. 26–29. Energy absorbing system 420 incorporating still another embodiment of the present invention is shown in FIGS. 30 and 31. Energy absorbing systems 120, 120*a* and 420 may sometimes be described as "non-gating, redirective crash cushions." Energy absorbing systems 120, 120*a* and 420 may also be described as "flared" systems because the end of each system disposed adjacent to a roadside hazard is typically substantially wider than the end of the respective system facing oncoming traffic.

Energy absorbing systems 120, 120*a* and 420 may include multiple energy absorbing assemblies 186 aligned in respective rows 188 and 189 extending generally longitudinally from first end 121 to a position intermediate an associated roadside hazard (not expressly shown). Rows 188 and 189 may also be aligned generally parallel with each other. Rows 188 and 189 and/or energy absorbing assemblies 186 may sometimes be referred to as a "guidance track" for sled assembly 40 and panel support frames 60*a*–60*g* (See FIGS. 19A and 24) or split panel support frames 460*a*–460*i* (See FIGS. 30 and 31). Some features associated with energy absorbing systems 120, 120*a* and 420 may be described with respect to longitudinal center line 130 disposed between rows 188 and 189.

An energy absorbing system incorporating teachings of the present invention may have energy absorbing assemblies arranged in various configurations. For some applications, only a single row of energy absorbing assemblies may be installed adjacent to a roadside hazard. For other applications, three or more rows of energy absorbing assemblies may be installed. Also, each row may only have one energy absorbing assembly or multiple energy absorbing assemblies. The present invention allows modifying an energy absorbing system to minimize possible injury to both restrained and unrestrained occupants in a wide variety of vehicles traveling at various speeds.

In fact, other types of energy absorbing assemblies can be utilized with systems 120, 120*a* and 420 of FIGS. 19A–31. The energy absorbing assemblies can utilize crushing, extruding, bursting, splitting, etc.

Energy absorbing assemblies 186 are preferably disposed on and securely attached to a plurality of crossties 24. For some applications, energy absorbing systems 120, 120*a* and/or 420 may be installed using a total of eight crossties 24 with four anchor bolts 26 per crosstie. Two anchor bolts 26 may be installed adjacent to each end of each crosstie 24. The number and location of crossties 24 and anchor bolts 26 may be varied to provide sufficient mechanical strength to resist large forces which may be generated when a vehicle impacts with one side of the associated energy absorbing system. For example, a relatively strong structural base and foundation may be required to satisfactorily redirect a vehicle impacting at an angle of approximately twenty degrees (20°) with a portion of an energy absorbing system having a flare of approximately seven degrees (7°).

A pair of guide rails or guide beams 208 and 209 are preferably attached to and extend laterally from respective energy absorbing assemblies 186. Sled assembly 40 may be slidably disposed on guide rails 208 and 209. Panel support frames 60*a*–60*g* of energy absorbing systems 120 and 120*a* and split panel support frames 460*a*–460*i* of energy absorbing system 42 may also be slidably disposed on guide rails 208 and 209. The length of guide rails 208 and 209 is preferably longer than the length of associated rows 188 and 189 of energy absorbing assemblies 186. When energy absorbing systems 120 and 120*a* are in their respective second position (not expressly shown), sled assembly 40 and panel support frames 60*a*–60*g* may be disposed adjacent to each other at the end of rows 188 and 189 opposite from first end 121. When energy absorbing system 420 is in its second position (not expressly shown), sled assembly 40 and split panel support frames 460*a*–460*i* may be disposed adjacent to each other at the end of rows 188 and 189 opposite from first end 121.

FIG. 19A is a schematic drawing showing a plan view of energy absorbing system 120, extending longitudinally from a roadside hazard (not expressly shown) which may include concrete barrier 310. Energy absorbing system 120 includes first end 121 facing oncoming traffic and second end 122 disposed adjacent to the roadside hazard. Energy absorbing system 120 also includes first side 131 and second side 132 which are spaced from each other and extend generally longitudinally between first end 121 and second end 122. For this embodiment first side 131 and second side 132 may be described as having a generally asymmetrical configuration relative to center line 130.

When energy absorbing system 120 is in its first position, sled assembly 40 may be slidably disposed at first end 121 facing oncoming traffic. Second end 122 of energy absorbing system 120 may be disposed adjacent to a relatively large, wide roadside hazard (not expressly shown). For the embodiment as shown in FIG. 19A, second end 122*a* of first side 131 may be attached with concrete barrier 310. Second end 122*b* of second side 132 may be attached with a similar concrete barrier or with portions of a conventional guardrail system (not expressly shown).

Multiple panels 160 may be attached to sled assembly 40 and panel support frames 60*a*–60*g* to form portions of first side 131 and second side 132. For the embodiment shown in FIG. 19A, first side 131 and second side 132 extend generally parallel with each other from first end 121 along at least a portion of centerline 130. Second side 132 of energy absorbing system 120 may be described as "flared" because second portion 132*b* of second side 132 is disposed at an angle relative to longitudinal center line 130, associated rows 188 and 189 and guide rails 208 and 209. The second portion 132*b* of the second side diverges from the center line 130 as the side extends toward the second end 122. First portion 132*a* of second side 132 disposed between first end 121 and support frame assembly 60*c* is preferably spaced from and aligned generally parallel with corresponding portions of first side 131. For some applications the distance between first end 121 and the location at which second portion 132*b* of second side 132 flares or extends at an angle from associated guide rails 208 and 209 may be approximately one hundred fourteen inches (114"). Providing modular base units of one hundred fourteen inches (114") also reduces the amount of testing required for the associated energy absorbing system to meet NCHRP Report 350 requirements.

Technical benefits of the present invention include providing modular base units which may be preassembled prior to delivery at a roadside location. For some applications a modular base unit may include rows 188 and 189, sled assembly 40, panel support frames 60*a*–60*g* with panels 160 installed along side 131 and panels 160 installed along approximately one hundred fourteen inches (114") of side 132. The use of a modular base unit may minimize repair time at a roadway location and allow for more efficient, cost effective repair of a damaged modular base unit at an off site repair facility.

FIG. 19B is an enlarged schematic drawing showing a plan view of the relationship between first portion 132*a* and second portion 132*b* of second side 132. For the embodiment represented by energy absorbing system 120 second portion 132*b* may be disposed at an angle of approximately seven degrees (7°) relative to first portion 132*a*. Bent plates or joint plates 74 may be used to couple panel support frame 60*c* and frame extensions 80*d*–80*g* with respective panels 160. Bent plate or joint plate 74 may be installed on the downstream side of panel support frame 60*c*. Respective joint plates or bent plates 74 may be installed on the upstream side of associated frame extensions 80*d*–80*g*. Bent plates 74 may include angle 76 having a value of approximately seven degrees (7°) which corresponds generally with the angle formed between first portion 132*a* and second portion 132*b* of second side 132. See FIG. 19C.

Figure 16:
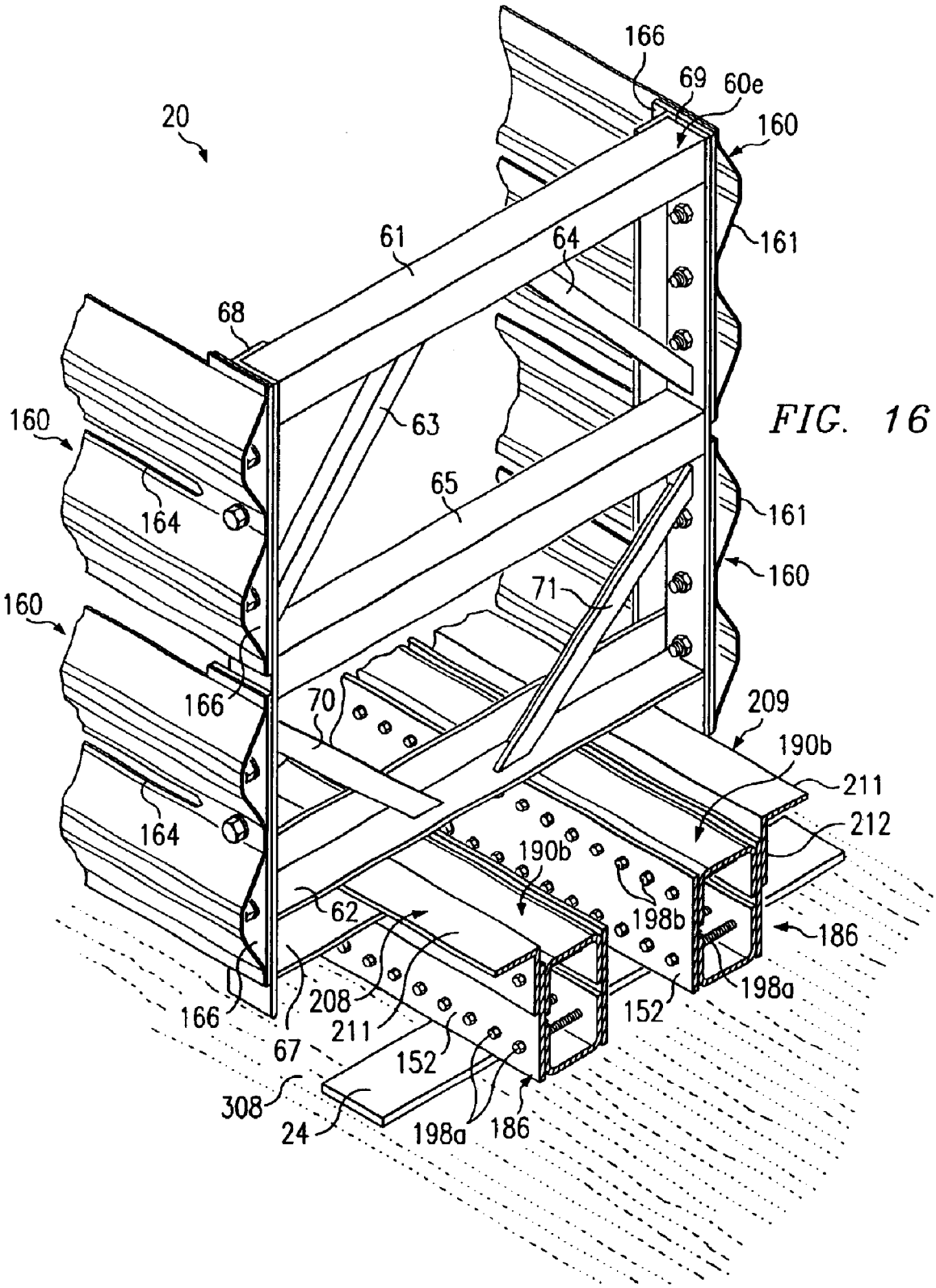
FIG. 16 is a schematic drawing with portions broken away showing an isometric view of a panel support frame and attached panels associated with the energy absorbing system of FIG. 10.

The joint plates 74 are used in conjunction with the straps 166 of FIGS. 16 and 17*a*. The straps 166 are used to couple the panels to the panel support frames 60*a*, 60*b* and to the sled 40, wherein the panels extend generally perpendicular to the panel support frames. Where the panels are nonperpendicular to the panel support frames, or to other types of supports, the joint plates 74 are used to couple the panels to the corresponding supports. Angle 76 of joint plate 74 (see FIG. 19C) generally corresponds to the angle of the panels with respect to the associated supports. Joint plates 74 are not needed to couple the panels to the wing extension panel support frames 360*h*–360*m*, as the panels generally extend perpendicular to the panel support frames. Each joint plate 74 includes a first portion 74*a* and a second portion 74*b*. The first and second portions 74*a*, 74*b* have openings therein for bolts.

FIG. 19B illustrates the use of the joint plates 74. One joint plate 74 is coupled to the panel support frame 60*d* (more specifically to the extension 80*d*). Specifically, the first portion 74*a* of the plate 74 is bolted to the extension 80*d* and the second portion 74*b*, which extends toward the first end 121 and inward toward the center line 130, is bolted to a strap 166 that is connected to the panel 160*dd*. The end of the panel 160*dd* that is toward the first end 121 is fixedly coupled to the plate. The end of the panel 160*cc* that is toward the second end 122 is slidingly coupled to the joint plate 74, in the same manner as discussed above with reference to FIG. 15. Another joint plate 74 is coupled to the panel support frame 60*c*. Specifically, the first portion 74*a* is bolted to the panel support frame 60*c* and the second portion 74*b*, which extends toward the second end 122 and away from the center line 130, is bolted to a strap 166 (not expressly shown in FIG. 19B) on the panel 160*cc*. The adjacent end of the panel 160*bb* is slidingly coupled to the panel support frame 60*c*, as previously discussed with reference to FIG. 15.

Energy absorbing system 120 may also be described as "right side flared". For some applications, first side 131 may be flared relative to center line 130 (not expressly shown) and second side 132 may extend generally parallel with center line 130 (not expressly shown). The resulting energy absorbing system may be described as "left side flared" (not expressly shown). The present invention allows an energy absorbing system to be designed and installed based on associated geometry of each roadside hazard and installation topography. For example, one side of an energy absorbing system formed in accordance with teachings of the present invention may be flared near an exit ramp (not expressly shown) at an angle corresponding with an angle formed between the main line of traffic flow and the exit ramp. An energy absorbing system having a single side flare allows an associated energy absorbing assembly to remain substantially parallel with the main direction of traffic flow while still providing substantially continuous crash protection for vehicles exiting from the main line of traffic flow onto an exit ramp.

Starting with panel support frame 60*d*, respective frame extensions 80*d*–80*g* may be disposed adjacent to associated panel support frames 60*d*–60*g*. Frame extensions 80*d*–80*g* may slide longitudinally along with respective panel support frames 60*d*–60*g*. Respective outboard anchor assemblies 110*e*–110*g* are preferably secured adjacent to row 189 and spaced therefrom to support each frame extension 80*e*–80*g* at an angle corresponding generally with the angle of second portion 132*b* of second side 132. Frame extensions 80*e*–80*g* are preferably slidably disposed on their associated outboard anchor assembly 110*e*–110*g*. The number of frame extensions and the number of outboard anchor assemblies may be varied depending upon characteristics of each roadside hazard and angle or angles associated with sides 131 and 132.

For the embodiment represented by energy absorbing system 120 frame extensions 80*d*–80*f* may have similar overall configurations. Frame extensions 80*d*–80*g* may be described as having generally rectangular cross sections with one or more corner posts 68*a*, 69*a* coupled together by one or more cross braces 82. However, dimensions associated with each frame extension 80*d*–80*f* may be varied to accommodate the flare or angle formed by second portion 132*b* of second side 132. Frame extension 80*f* is shown in more detail in FIG. 21. One of the corner ports 68*a* of the frame extension may be fastened to one of the corner posts 68 of the panel support frame 60.

As shown in FIG. 19A, the width of frame extension 80*d* is generally smaller than the width of frame extensions 80*e*, 80*f* and 80*g*. As the width of frame extensions 80 increases, respective outboard anchor assemblies 110*e*–110*g* may be located at an appropriate distance from guide rail 209 to provide desired mechanical support for frame extensions 80*e*–80*g* and associated panels 160. Since the width of frame extension 80*d* is less than the width of the other frame extension 80*e*–80*g*, an outboard anchor assembly 110 may not be required for frame extension 80*d* at some roadside installations.

Various features of outboard anchor assemblies 110*e*–110*g* are shown in FIGS. 19A, 20, 21, 22 and 25. Each outboard anchor assembly 110*e*–110*g* preferably includes respective base plate 112, four anchor bolts 26 and guide plate 114. Webs or supporting members 116, 116*a* may be used to mount guide plate 114 with respective base plate 112. Respective hooks 117 may be attached with the exterior of each frame extension 80*e*, 80*f* and 80*g* adjacent to guide plates 114. The dimensions of each hook 117 are preferably selected to allow respective frame extensions 80*e*–80*g* to slide longitudinally relative to the associated guide plate 114. Each hook 117 cooperates with its associated guide plate 114 to prevent rotation of associated frame extension 80*e*–80*g* during a vehicle impact with side 132. Web 116*a* is positioned on the opposite side of the web 116 from the hook 117. Thus, the outboard anchor assembly forms a channel for receiving the hook 117, which channel is generally parallel to the center line 130. The web 116*a* provides resistance of the outboard anchor assembly to rotation.

An energy absorbing system formed in accordance with teachings of the present invention may be mounted on or attached to either a concrete or asphalt foundation (not expressly shown). For some installations, anchor bolts 26 may vary in length from approximately seven inches (7") to approximately eighteen inches (18"). For some applications, holes (not expressly shown) may be formed in an asphalt or concrete foundation to receive respective anchor bolts 26. Various types of adhesive materials may also be placed within the holes to secure anchor bolts 26 in place. Preferably anchor bolts 26 do not extend substantially above the tops of associated nuts 27. Concrete and asphalt anchors and other fasteners satisfactory for use in installing an energy absorbing system incorporating teachings of the present invention are available from Hilti, Inc., at P.O. Box 21148, Tulsa, Okla. 74121.

Respective deflector plates or ramps 136 may be attached to each outboard anchor assembly 110*e*–110*g* in a direction extending towards first end 21 of energy absorbing system 120. The ramps 136 extend from the mount guide plate 114 to the ground or to the level of the base plate 112. Deflector plates or ramps 136 function in a manner similar to previously described for ramps 36. If a vehicle should impact with side 132 in the vicinity of outboard anchor assemblies 110*e*–110*g*, deflector plates 136 will prevent the wheels of the vehicle from directly impacting or engaging outboard anchor assemblies 110*e*–110*g*. The ramps 136 also serve in a collision to the first end 121, which collapses the energy absorbing mechanism, as will be discussed in more detail hereinafter.

When energy absorbing system 120 is disposed in its first position, frame extensions 80*d*–80*g* are preferably disposed immediately adjacent to associated panel support frames 60*d*–60*g*. Various types of mechanical fasteners, such as bolts 88 may be satisfactorily used to attach frame extensions 80*d*–80*g* with panel support frames 60*d*–60*g*. If a vehicle impacts second side 132 adjacent to frame extensions 80*d*–80*g*, associated impact forces or kinetic energy will be transferred from frame extensions 80*d*–80*g* to outboard anchor assemblies 110*c*–110*g* from respective hooks 117 and to adjacent panel support frames 60*d*–60*f*, guide rail 209 and energy absorbing assemblies 186.

Figure 21:
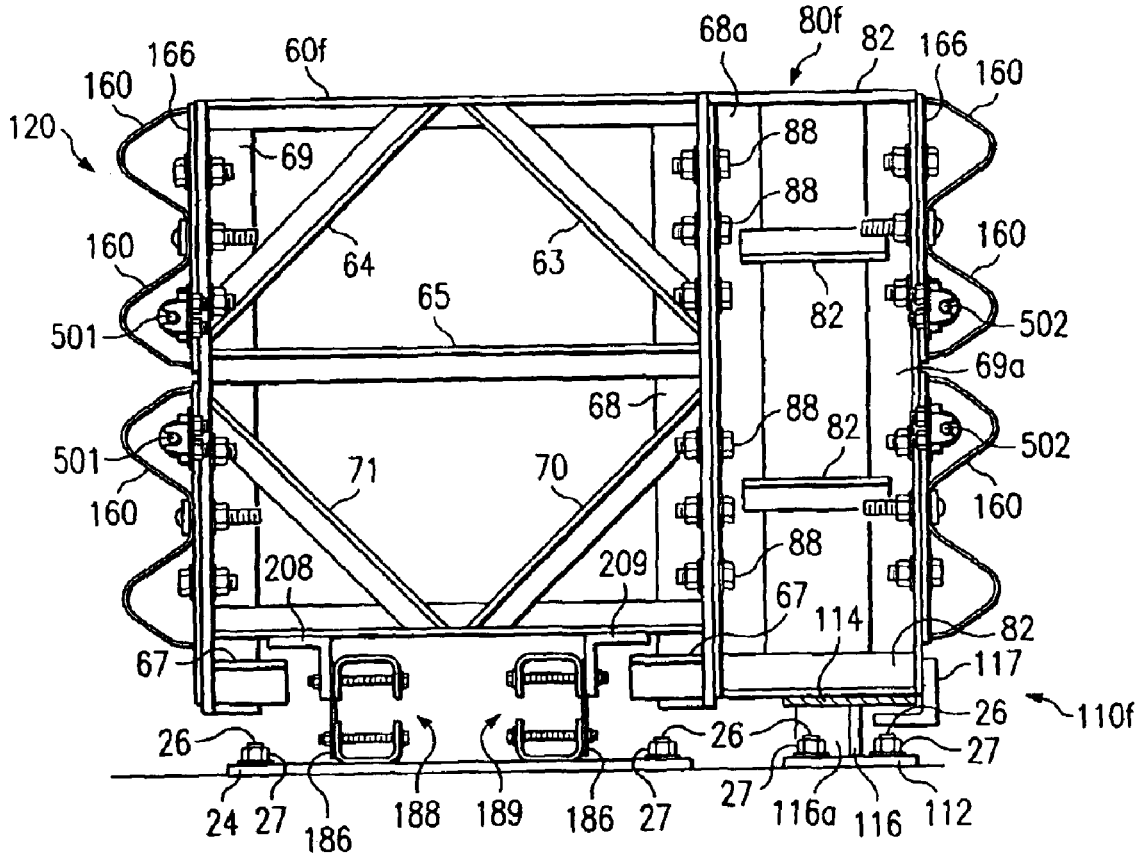
FIG. 21 is a schematic drawing in section with portions broken away taken along lines 21—21 of FIG. 19A.

The outboard anchor assemblies 110*e*–110*g* are particularly useful when the second side 132 is impacted by a relatively tall vehicle, such as a pickup. Referring to FIG. 21 to illustrate, the impact is typically on the upper right panel 160 and tends to rotate the frame extension 80*f* and the panel support frame 60*f* counterclockwise about rails 208, 209. Such a rotation may impart an undesirable roll to the impacting vehicle. The hook 117 prevents rotation, thereby minimizing vehicle roll. The impacting vehicle is redirected onto the road in an upright condition.

An energy absorbing system with wing extensions formed in accordance with teachings of the present invention may be expanded from a width of approximately twenty-four inches (24") to any width required to accommodate large or wide roadside hazards. For the embodiment represented by energy absorbing system 120, second portion 132*b* of second side 132 preferably includes a wing extension. The wing extension of second portion 132*b* may be formed in part by a plurality of panel support frames or wing extension support frames 360 and conventional W-beam guardrail panels 260 such as ten (10) gauge guardrails. For some applications, the length of panels 260 may be varied in increments from approximately twenty-eight inches (28") to approximately two hundred and eighty inches (280"). Panels 260 preferably continue at approximately the same height extending from associated panels 160. See FIG. 20.

Panel support frames designated 360*h*–360*m* may be disposed between the end of rows 188 and 189 and an associated roadside hazard. See FIGS. 19A, 20 and 24. Panel support frames 360*h*–360*m* may be securely attached with an asphalt or concrete foundation (not expressly shown) or otherwise securely anchored in place. The number of panel support frames 360 may be varied depending upon width of an associated roadside hazard and distance of the roadside hazard from the ends of guide rails 208 and 209. For some applications, panel support frames 360*h*–360*m* may be installed on approximately twenty-eight inch (28") centers.

For some applications each panel support frame 360 may have a generally triangular configuration defined in part by respective post 362, wing extension base plate 364 and strut or brace 366. A plurality of anchor bolts 26 may be used to securely engage base plate 364 with an associated concrete foundation. Each post 362 may have a cross section and dimensions associated with a typical highway guardrail support post or I-beam. Base plate 364 may be formed from the same material and have dimensions similar to crossties 24. Strut 366 may also be formed from an I-beam or other suitable type of highway structural material.

Figure 20:
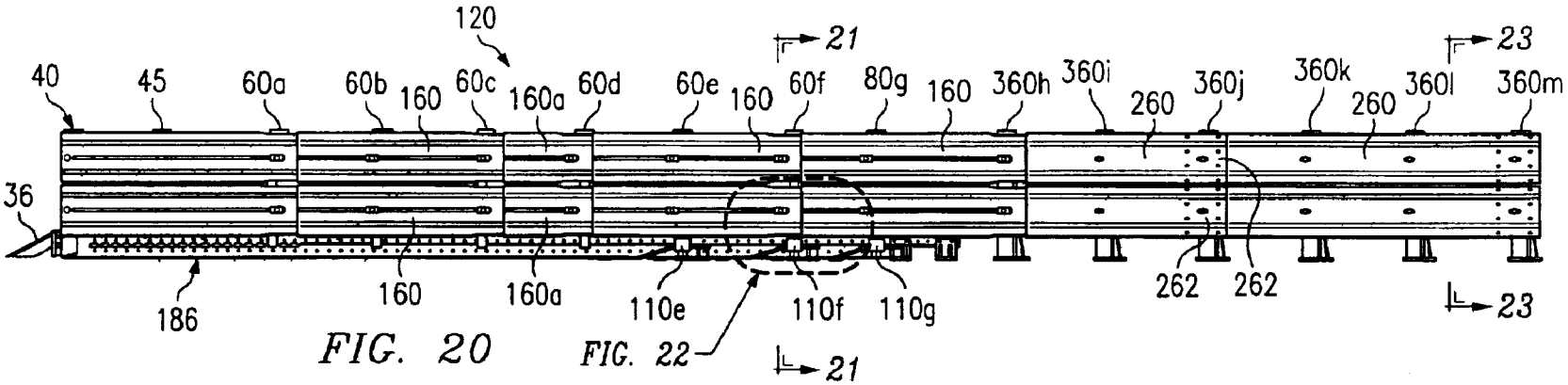
FIG. 20 is a schematic drawing in elevation with portions broken away showing a side view of the energy absorbing system of FIG. 19A.

Energy absorbing system 120 as shown in FIG. 20 may include splices 262 between overlapping panels 260 proximate panel support frame 360*j*. For some applications wing extensions may be formed with panels 260 having a length corresponding with the distance between the end of panels 160 and an associated road side hazard to eliminate the need for splices 262. Also, panel support frames 360 and panels 260 may be preassembled (not expressly shown) and delivered to a work site for installation as a complete unit. An energy absorbing system may be relatively quickly installed adjacent to a roadside hazard by using a preassembled modular base unit and one or more preassembled wing extensions.

An energy absorbing system may be formed in accordance with teachings of the present invention having wing extensions which are secured in place using other types of support posts and supporting structures associated with highway guardrail safety systems. The present invention is not limited to panel support frames 360. Wing extensions formed in accordance with teachings of the present invention allow the use of a greater taper rate from the associated roadside hazard and the energy absorbing assembly. As a result the overall length of an associated energy absorbing system may be substantially reduced while at the same time providing the same or increased safety for an impacting vehicle and its occupants.

For some applications generally C-shaped channels may be attached to panel support frames 360. For the embodiment shown in FIG. 23, C-shaped channel 368 may be disposed between lower panels 260 and associated posts 362. Bolts 370 may be satisfactorily used to attach both panels 260 and associated C-shaped channels 368 with posts 362. For some applications C-shaped channels 368 provide required strength to allow the associated wing extension to resist rail face impacts. For some applications C-shaped channels (not expressly shown) may also be installed between the upper set of panels 260 and associated posts 362. Eight inch (8") deep channels may be preferred for some applications. The channel 368 preferably extends for the full length of the set of panels.

Panels 160 are preferably slidably coupled with respective panel extensions 80*d*–80*g* in substantially the same manner as previously described with respect to panel support frames 60. Starting at panel support frame 360*j*, conventional W-beams 260 may be securely attached to and mounted on panel support frame 360*h*–360*m*. The number of panel support frames 360 and the number of panels 260 may be varied depending upon the distance between the end of rows 188 and 189 and the associated roadside hazard. Respective spliced joints 280 (See FIG. 29) may be disposed between panels 160 and associated W-beams 260 at panel support frame 360*j*.

If panels 160 and/or 260 are hit, during a side impact, an impacting vehicle will be redirected back to the adjacent roadway and away from the associated roadside hazard. The vehicle impact may be transmitted from panels 160 directly to adjacent panel support frames 60 or to frame extensions 80 and then to panel support frames 60 depending upon the location of the side impact. Panel support frames 60 will attempt to rotate, as panels 160 are usually hit high. However, panel support frames 60 are prevented from rotating on guide rails 208 and 209 by inwardly extending projections or tabs 67 underneath beam guides on the rails.

Figure 23:
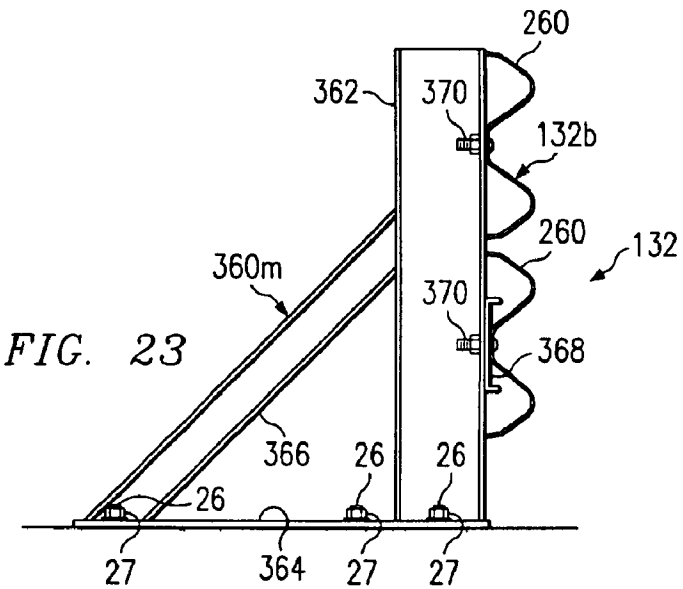
FIG. 23 is a schematic drawing in elevation and in section with portions broken away taken along lines 23—23 of FIG. 19A showing one example of a wing extension base plate, support post and brace.
Figure 22:
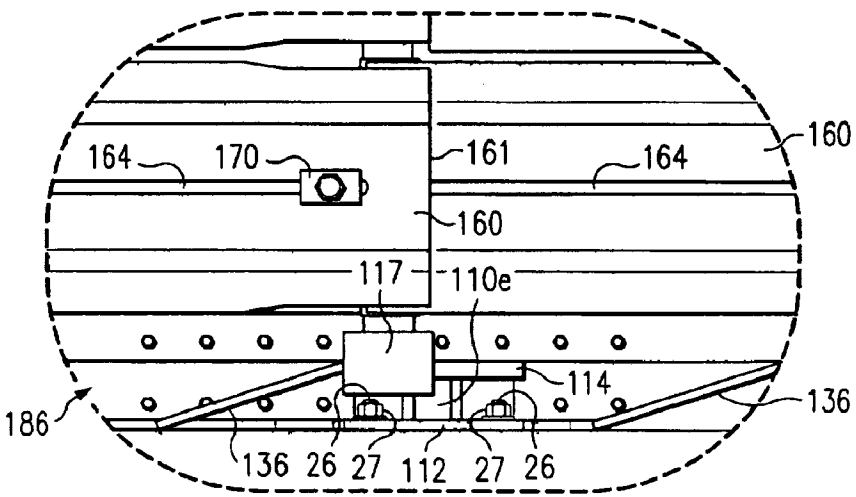
FIG. 22 is an enlarged schematic drawing in elevation with portions broken away showing a side view from FIG. 20 of one example of an outboard anchor assembly.

Referring to FIG. 23, the vehicle impact, during a side impact, may be transmitted from W-beam panels 260 directly to adjacent panel support frames 360*h*–360*m*. Panel support frames 360*h*–360*m* are prevented from rotation by associated strut 366 and base plate 364. Both crossties 24 and base plates 364 may bend or be deformed by a side impact. Thus, the system "gives" during a side impact by allowing crossties 24 and base plates 364 to deform. Much like the system's collapse during a head on collision, this "give" on a lateral or side impact reduces deceleration forces applied to a side impacting vehicle. Systems 120, 120*a* and 420 generally remain in place after a redirecting lateral or side impact.

FIGS. 24 and 25 are schematic drawings showing various features of energy absorbing system 120*a*. Energy absorbing system 120*a* includes first end 121 facing oncoming traffic and second end 122*c* disposed adjacent to an associated roadside hazard (not expressly shown). First end 121 of energy absorbing system 120 and 120*a* may have substantially the same configuration and dimensions. Energy absorbing system 120*a* also includes first side 131*c* and second side 132. First side 131*c* may be described as having a left side flare. Second side 132 may be described as having a right side flare. For the embodiment represented by energy absorbing system 120*a* first side 131*c* and second side 132 may have substantially the same configurations and dimensions except for respective left side flare and the right side flare. Second side 132 of energy absorbing systems 120 and 120*a* may also have substantially the same configuration and dimensions based in part of the distance between the end of rows 188 and 189 and an associated roadside hazard.

Various components of energy absorbing system 120*a* may be generally symmetrically disposed with respect to center line 130. First side 131*c* and second side 132 extend generally parallel with each other along at least a portion of associated guide rails 208 and 209. First portion 131*a* of first side 131*c* and first portion 132*a* of second side 132 extend generally parallel with each other from first end 121 along at least a portion of center line 130. Second portion 131*b* of first side 131*c* may be disposed at approximately the same angle relative to first portion 131*a*. Second portion 132*b* of second side 132 may be disposed at approximately the same angle relative to first portion 132*a*.

When energy absorbing system 120*a* is in its first position, sled assembly 40 will be slidably disposed at first end 121 facing oncoming traffic. Second end 122*c* of energy absorbing system 120*a* may be disposed adjacent to a relatively large, wide roadside hazard (not expressly shown). Second end 122*a* of first side 131*c* and second end 122*b* of second side 132 may be attached with a concrete barrier or other portions of a conventional guardrail system (not expressly shown). Portion 131*b* of first side 131*c* and portion 132*b* of second side 132 may both be disposed at approximately the same angle relative to longitudinal center line 130. Proximate panel support frame 60*c*, both portion 131*b* of first side 131*c* and portion 132*b* of second side 132 may be disposed at approximately seven degrees (7°) relative to portion 131*a* and portion 132*a*.

Second portion 131*b* of first side 131*c* preferably includes a second group of panel support frames designated 360*h*–360*m* and multiple panels 260 securely attached thereto as previously described with respect to energy absorbing system 120. As shown in FIG. 25 a pair of side extensions 80*f* are preferably disposed on opposite sides of panel support frame 60*f*. Associated panels 160 may be slidably attached with respective side extensions 80*f*.

When an impacting vehicle strikes the first end 121 of the energy absorbing system 120, 120*a*, the sled 40 is moved and the energy absorbing assembly engages. The panel support frames 60*a*–60*b* move along the guide rails 208, 209, and the panels 160 attached thereto telescope along the axis of the guide rails, as discussed above. As the sled continues to move along the guide rails, panel support frames 60*c*–60*f* will likewise begin to move in sequential manner, also along the guide rails. As panel support frame 60*c* moves toward the second end 122, panel 160*cc* (see FIG. 19B) telescopes over panel 160*dd*.

The panels 160 change their orientation to the guide rails 208, 209, becoming less parallel and more perpendicular. The coupling between the joint plates 74 and the straps 166 bend and allow the panels to change orientation so as to increase the angle with respect to the center line 130. The sliding connection formed by the slot plate 170 (see FIG. 15) allows the downstream end of the panels to uncouple to further assist in the panels changing orientation due to a first end impact.

The frame extensions 80*d*–80*g* generally move in unison with the respective associated panel support frames 60*d*–60*g*. The frame extensions move in a direction generally parallel to the guide rails 208, 209. Each hook 117 (see FIG. 22) moves in unison with the respective frame extensions. The hooks 117 move toward the second end 122 (to the right in the orientation of FIG. 22), moving beneath their initial mount guide plate 114. Each hook 117 clears the respective mount guide plate 114 and continues its motion, contacting the ramp 136 that is located downstream. The hook 117 rides the ramp 136, lifting its associated panel extension and the panel support frame. As shown in FIG. 21, there is vertical clearance between the tabs 67 and the guide rails 208, 209, wherein the panel support frames 60 can elevate slightly from the guide rails, to enable the hooks 117 to elevate on the ramps 136.

Referring back to FIG. 22, as the panel support frame continues to move along the guide rails, the hook slides from the ramp along the top of the mount guide plate and then falls from the trailing, or downstream, edge of the mount guide plate 114. The hook moves further downstream and contacts the next ramp, repeating the process.

As shown in FIG. 19A, the outboard anchor assemblies 110*e*–110*g* are spaced increasingly further away from the guide rails, in the direction of traffic. Thus, a hook 117 (such as the hook connected to frame extension 80*e*) may pass between the guide rail 209 and an outboard anchor assembly (such as outboard anchor assembly 110*g*) without traversing up the ramp 136. The ramp 136 preferably has a tapered inner edge 136*a* (see FIG. 25) that faces the guide rails. The passing hook 117 may contact the inner edge 136*a* and be forced toward the guide rails. The outboard anchor assemblies that are positioned downstream may be spaced far enough apart that the hooks 117 on an upstream panel may avoid contact with those downstream outboard anchor assemblies. By way of example, as shown in FIG. 24, the hooks couple to the panel support frame 60*e*, and by way of its associated frame extensions 80*e*, ride the ramps upon the outboard anchor assemblies 110*f*, and pass between the outboard anchor assemblies 110*g*. Thus, the outboard anchor assemblies, while operating during a side impact to the energy absorbing system, do not interfere with a nose impact collapse of the system.

The tapered inner edge 136*a*, which is on the same side as the web 116*a*, also serves as a visual reference to ensure that the web 116*a* is located inboard, so as not to interfere with the motion of the hook 117 in a first end 121 impact.

Because portion 131*b* of first side 131*c* and portion 132*b* of second side 132 are at an angle with respect to the guide rails, and even in many circumstances, at an angle with respect to the direction of vehicular traffic, reinforcement of the panels 160 is desired to minimize the possibility of a vehicle passing through the panels.

At least one cable assembly and preferably two or more cable assemblies may be coupled with sled assembly 40 and at least a portion of the first side and/or second side of an associated energy absorbing system. Each cable assembly may include one or more cables, multiple cable clamps and multiple clamp plates. As shown in FIGS. 19A, and 24–28B first cable 501 and second cable 502 may extend longitudinally along associated panels 160 from panel support frames 360*h* to associated sled assembly 40. The free ends of cables 501 and 502 may be secured with respective posts 362 in the wing extensions using various techniques such as cable clamps 510. See FIG. 27. First cable 501 may extend along the panels on the first side 131*c* (see FIG. 24) toward the first end 121. At the panel support frame 60*a*, the first cable 501 crosses over the guide rails 208, 209 to wrap around an upright at second end 42 of sled assembly 40 and loop back to the wing extension on the first side by extending diagonally thereacross to approximately the location of panel support frame 60*a*. Second cable 502 follows a similar path along the second side 132 and may be wrapped around an opposite upright at second end 42 of sled assembly 40 and extend diagonally thereacross to a position proximate panel support frame 60*a*. First cable 501 and second cable 502 provide additional tension support to help respective first side 131 and second side 132 resist side impacts. For some applications cables 501 and 502 may be formed with wire rope having a diameter of approximately one-half of an inch.

First cable 501 and second cable 502 provide additional anchorage and tensile strength to allow respective sides 131, 131*c* and 132 to satisfactorily redirect a vehicle impacting at approximately twenty degrees (20°)with portions of sides 131, 131*c* and/or 132 flared at an angle of approximately seven degrees (7°). Portions of cables 501 and 502 may be threaded between the humps of respective panels 160 from a downstream location proximate panel support frame 360*h* to a respective upright associated with sled assembly 40. Each cable 501 and 502 may then be returned through the humps of a lower panel to panel support frame 360*h*.

Figure 28A:
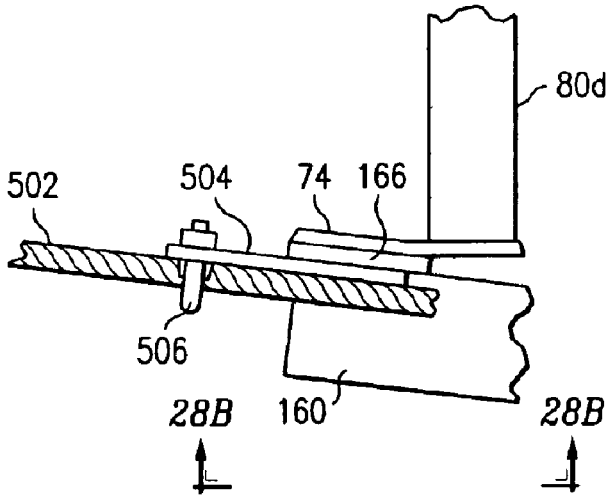
FIG. 28A is a schematic drawing showing a plan view with portions broken away of a cable coupled with one side of an energy absorbing system in accordance with teachings of the present invention.
Figure 28B:
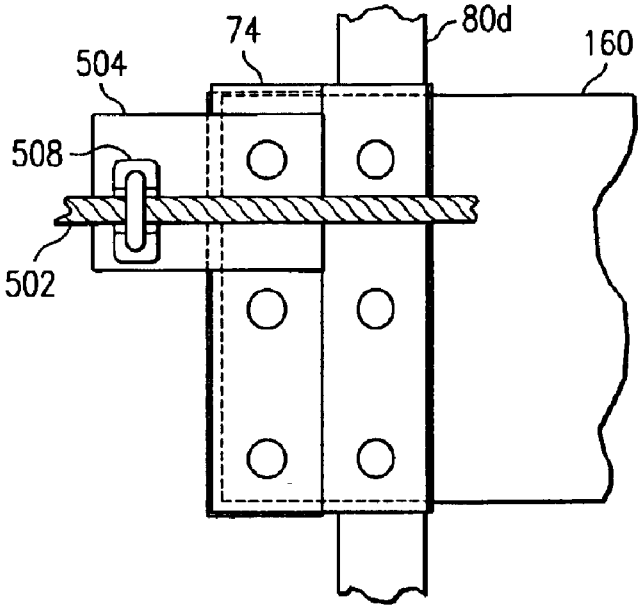
FIG. 28B is a schematic drawing in elevation with portions broken away showing the cable and associated coupling of FIG. 28A.
Figure 29:
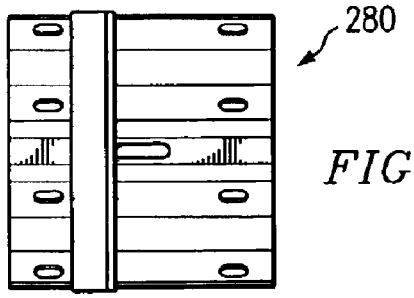
FIG. 29 is a schematic drawing in elevation showing one example of a coupling which may be used to connect a panel that slides with a panel that does not slide.

FIGS. 28A and 28B show portions of cable 502 adjacent to frame extension 80*d*. For this embodiment respective clamp plates 504 may be securely attached with associated bent plate 74. A generally U-shaped cable clamp 506 may be inserted through an opening 508 formed in each clamp plate 504 to secure a portion of cable 502 at the desired location relative to panel 160 and panel support frame 60*c*.

The cables 501, 502 are preferably coupled to each of the panel support frames 60*a*–60*c* and the frame extensions 80*d*–80*g*. The ends of the cables can be coupled to the downstream-most frame extension, or to the roadside hazard itself. The cables can also be extended into the wing extension panels 260.

Energy absorbing system 420 as shown in FIGS. 30 and 31 demonstrates that the flare of first side 431 and second side 432 may start at first end 121. Energy absorbing system 420 is also another example of an energy absorbing system formed in accordance with teachings of the present invention with asymmetrical sides.

A plurality of split panel support frames 460*a*–460*i* may be used with energy absorbing system 420 to allow respective sides 431 and 432 to be flared at various angles and to accommodate various widths as desired. Split panel support frames 460*a* and 460*b* may be slidably attached with guide rail 208. Split panel support frames 460*c*–460*i* may be slidably attached to guide rail 209. The dimensions and configurations associated with split panel support frames 460 may be varied as required to accommodate the angle or flare of respective sides 431 and 432. Respective outboard anchor assemblies 110 may also be provided as required for each split panel support frame 460.

Cables, such as 501 and 502 previously discussed, can be used with the energy absorbing system 420.

Hinges 430 couple the sides 431, 432 to the first end 121 of the energy absorbing system 420. The hinges 430, which are of the pin type, allow the sides 431, 432 to be moved to the desired angle. For each side, the hinges are coupled to the straps 166 inside of the panels 160 and to the first end upright 41, 43 of the sled assembly 40. The uprights can be angle posts, much like the uprights 44, 45 on the downstream side of the sled assembly.

The hinges 430 not only serve as hinges during installation of the energy absorbing system 420, but serve as hinges during a vehicle impact with the first end 121. As the sled assembly 40 moves along the guide rails 208, 209, the angle that the panels 160 on each side make with the center line 130 changes, as allowed by the hinges 430.

The split panel support frames allow the angle of the individual sides to be independently adjusted with respect to the guide rails 208, 209 and to the opposite side. With the split panel support frames, the first side 431 has a set of parallel support frames that are independent of the set of panel support frames that connect to the second side 432. The split panel support frames can also be used as an alternative to the panel extensions 80 of systems 120, 120*a* of FIGS. 19A and 24.

One example of a split panel support frame satisfactory for use with the present invention is shown in FIG. 31. Split panel support frame 460*h* may be slidably engaged with or slidably disposed on guide rail 209 and outboard anchor assembly 110*h*. Outboard anchor assembly 110*h* provides additional support for split panel support frame 460*h*.

Split panel support frames 460 may have two components designated 461 and 462. For some applications each split panel support frame 460 may include respective first component 461 with approximately the same overall configuration and dimensions. The configuration and dimensions of second component 462 may be varied to accommodate the flare or spacing between sides 431 and 432 and respective guide rails 208 and 209. Bolts 88 may be used to attach first component 461 with second component 462. Each split panel support frame 460 may include respective post 468 having dimensions and an overall configuration corresponding with post 68 or 69 of panel support frames 60. For the embodiment shown in FIG. 31, each component 461*h* and 462*h* may be described as having a generally triangular cross-section or configuration.

As shown in FIG. 31, the split panel support frame 460*c* can simply bear on the guide rail 209 and on the respective outboard anchor assembly 110*h*. During a side impact with the panels 160, the hook 117 and outboard anchor assembly prevent the split panel support frame from moving in toward the guide rail 209. Rotation of the split panel support frame, and consequently of the panels 160, is prevented by the hook 117 engaging the outboard anchor assembly 110*h* and the first component 461*h* bearing on the guide rail 209. During an impact with the first end 121 of the system 420, the split panel frame moves off of the outboard anchor assembly 110 and slides along the guide rail toward the second end 122.

The split panel frame can be used without the first component 461, as illustrated by split panel frames 460*c*–460*g* of FIG. 30, wherein the second component bears on the guide rail. The first component 461 forms an inward extension and is used on split panel support frames 406*a*–460*b*, 460*h*–460*i*.

Split panel support frames 460*j*–460*n* utilize the first component 461 as a leg. The first component 461 extends down to bear on the ground (see the dash lines in FIG. 31). The first component 461 is bolted to the bottom of the second component 462.

A variety of configurations of the split panel support frames can be utilized. FIG. 30 is for illustrative purposes only. The split panel support frames support the panels 160, resist side impacts by cooperating with the outboard anchor assemblies 110 and allow the movement of the system along the center line 130 during an impact to the first end 121. The divergence of each side can be adjusted independently of the other side. In FIG. 30, the side 431 has a larger divergence than does the side 432.

Although the present invention has been described in detail, it should be understood that various changes, substitutions and alterations can be made hereto without departing from the spirit and scope of the invention as defined by the appended claims.

What is claimed is:

1. An energy absorbing system to minimize the results of a collision between a moving vehicle and a roadside hazard comprising:

at least one guide having a first end and a second end;

the first end of the guide corresponding proximately with a first end of the system facing oncoming traffic;

a first group of panel support frames slidably disposed to the guide;

a second group of panel support frames spaced from each other and securely anchored at respective locations between the second end of the guide and the roadside hazard;

a first group of panels slidably attached to the first group of panel support frames whereby the first group of panel support frames and associated first group of panels collapse toward the second end of the guide when a vehicle impacts the first end of the system;

a second group of panels securely attached to the second group of panel support frames whereby the second group of panel support frames and associated second group of panels resist vehicle impacts;

at least a portion of the second group of panel support frames and associated second group of panels disposed at an angle relative to the guide;

the energy absorbing system having a first position with each panel support frame of the first group of panel support frames spaced longitudinally from adjacent panel support frames;

the first group of panel support frames and the associated panels forming a series of bays extending generally longitudinally from the first end to the second end of the guide;

a plurality of two-bay panels defined in part by selected panels having their respective first end securely attached to a first panel support frame and each panel of the two-bay panels slidably attached with two panel support frames disposed downstream from the first panel support flame; and at least one one-bay panel defined by a second panel support frame with the first end of selected panels securely attached thereto and each panel of the one-bay panel slidably attached to only one panel support frame disposed downstream from the second panel support frame.

2. A crash cushion to minimize the results of a collision between a vehicle and a roadside hazard, comprising:

an energy absorbing assembly extending in a first direction from the first end of the crash cushion;

plural panels located on a first side of the energy absorbing assembly and extending generally in the first direction, the panels resisting an impact from a vehicle with the first side;

the panels having a first section that is generally at a first orientation with respect to the first direction, the first section of panels extending from the first end to a location along the first side; and the panels having a second section extending from the location at a second orientation with respect to the first direction, the second section of panels intersecting the first section of panels at an angle; and a plurality of panels located on a second side of the energy absorbing assembly opposite of the first side and extending generally in the first direction, the second aide of panels being asymmetric from the first side of panels.

3. An energy absorbing system to minimize the results of a collision between a moving vehicle and a roadside hazard comprising:

at least one guide having a first end and a second end;

the first end of the guide corresponding proximately with a first end of the system facing oncoming traffic;

a first group of panel support frames slidably disposed on the guide;

a second group of panel support frames spaced from each other and securely anchored at respective locations between the second end of the guide and the roadside hazard;

a first group of panels slidably attached to the first group of panel support frames whereby the first group of panel support frames and associated first group of panels collapse toward the second end of the guide when a vehicle impacts the first end of the system;

a second group of panels securely attached to the second group of panel support frames whereby the second group of panel support frames and associated second group of panels resist vehicle impacts;

the second group of panel support frames and associated second group of panels disposed at an angle relative to the guide; and the second group of panels disposed asymmetric relative to the first group of panels and the at least one guide.

4. The energy absorbing system of claim 3 further comprising at least two panels attached to each panel support frame.

5. The energy absorbing system of claim 3 further comprising a first side and a second side extending generally longitudinally between the first end and a second end proximate the roadside hazard.

6. The energy absorbing system of claim 3 wherein the first group of panel support frames further comprises:

each panel support frame having a generally rectangular configuration; and the associated first group of panels respectively attached to opposite sides of the first group of panel support frames.

7. The energy absorbing system of claim 3 further comprising at least one energy absorbing assembly disposed adjacent to the guide.

8. The energy absorbing system of claim 3 further comprising:

a first side extending generally longitudinally between the first end and a second end;

a second side spaced from the first side and extending generally longitudinally between the first end and a second end proximate the roadside hazard;

the first side extending generally parallel with the guide; and the second side including the portion of the second group of support frames and associated second group of panels disposed asymmetric relative to the guide.

9. The energy absorbing system of claim 3 further comprising:

a first side extending generally longitudinally between a first end and a second end spaced longitudinally from the first end;

a second side spaced from the first side and extending generally longitudinally between a first end and a second end proximate the roadside hazard;

the first side having a first end proximate the first end of the system;

the second end of the first side coupled with one end of a concrete barrier; and the second side including the portion of the second group of support frames and associated second group of panels disposed asymmetric relative to the guide.

10. The energy absorbing system of claim 3 further comprising:

a first side extending generally longitudinally between a first end and a second end disposed proximate the roadside hazard;

a second side spaced from the first side and extending generally longitudinally between a first end and a second end proximate the roadside hazard;

the first end of the first side and the first end of the second side disposed proximate the first end of the system;

the first end of the first side and the first end of the second side spaced from each other at a first distance; and the second end of the first side and the second end of the second side spaced from each other by a distance at least twice the distance at the first end.

11. The energy absorbing system of claim 3 wherein the at least one guide further comprises a pair of guide rails.

12. The energy absorbing system of claim 3 further comprising the first group of panels and the second group of panels forming a substantially continuous barrier.

* * * * *